US010364082B2

(12) United States Patent
Coon et al.

(10) Patent No.: US 10,364,082 B2
(45) Date of Patent: Jul. 30, 2019

(54) CONTACT LENS PACKAGING AND METHODS OF MANUFACTURING PACKAGED CONTACT LENSES

(71) Applicant: CooperVision International Holding Company, LP, St. Michael (BB)

(72) Inventors: Mark Coon, Fairport, NY (US); Mark Hill, Fairport, NY (US); James Zicari, Fairport, NY (US); Leslie Burger, Fairport, NY (US); Lauren Potoky, Fairport, NY (US); Robert Davis, Eastleigh Hampshire (GB); Kathleen Myers, Fairport, NY (US)

(73) Assignee: CooperVision International Holding Company, LP, St. Michael (BB)

( * ) Notice: Subject to any disclaimer, the term of this patent is extended or adjusted under 35 U.S.C. 154(b) by 78 days.

(21) Appl. No.: 15/123,265

(22) PCT Filed: Mar. 31, 2015

(86) PCT No.: PCT/GB2015/050996
§ 371 (c)(1),
(2) Date: Sep. 2, 2016

(87) PCT Pub. No.: WO2015/150790
PCT Pub. Date: Oct. 8, 2015

(65) Prior Publication Data

US 2017/0096272 A1 Apr. 6, 2017

Related U.S. Application Data

(60) Provisional application No. 61/973,067, filed on Mar. 31, 2014.

(51) Int. Cl.
*B65D 75/32* (2006.01)
*B65D 71/22* (2006.01)
(Continued)

(52) U.S. Cl.
CPC ..... *B65D 75/326* (2013.01); *A45C 11/005* (2013.01); *B65B 11/004* (2013.01);
(Continued)

(58) Field of Classification Search
CPC ..... A45C 11/005; B65B 11/004; B65D 9/00
(Continued)

(56) References Cited

U.S. PATENT DOCUMENTS 3,948,388 A * 4/1976 Mueller ..... B65D 71/40 206/192
4,671,453 A * 6/1987 Cassidy ..... B65D 65/24 206/147
(Continued)

FOREIGN PATENT DOCUMENTS

EP 0223581 * 5/1993 ..... B65D 75/36
EP 1270441 A1 1/2003
(Continued)

OTHER PUBLICATIONS

International Search Report and Written Opinion issued in corresponding International Patent Application No. PCT/GB2015/050996 dated Jun. 30, 2015 (10 pages).
(Continued)

*Primary Examiner* — Anthony D Stashick
*Assistant Examiner* — Raven Collins
(74) *Attorney, Agent, or Firm* — Kilyk & Bowersox, P.L.L.C.

(57) ABSTRACT

A contact lens package includes a sealed contact lens package and a wrap coupled to the sealed contact lens package. The wrap has one or more panels. One of more of the panels includes a printed surface that includes a unique device identifier, which is provided in both human readable form that includes numbers or letters, or both, and machine readable form, such as a bar code. A method of manufac-
(Continued)

turing a contact lens package includes providing the sealed contact lens package and coupling the wrap to the sealed contact lens package.

18 Claims, 22 Drawing Sheets

(51) Int. Cl.

| | |
|---|---|
| ***B65D 75/52*** | (2006.01) |
| ***B65D 77/04*** | (2006.01) |
| ***A45C 11/00*** | (2006.01) |
| ***B65B 11/00*** | (2006.01) |
| ***B65D 69/00*** | (2006.01) |
| ***B65D 75/00*** | (2006.01) |
| ***B65D 75/54*** | (2006.01) |
| ***B65D 75/58*** | (2006.01) |
| ***B65D 81/22*** | (2006.01) |
| ***B65D 85/00*** | (2006.01) |

(52) U.S. Cl.
CPC ..... *B65D 69/00* (2013.01); *B65D 71/22* (2013.01); *B65D 75/002* (2013.01); *B65D 75/525* (2013.01); *B65D 75/527* (2013.01); *B65D 75/54* (2013.01); *B65D 75/58* (2013.01); *B65D 77/0433* (2013.01); *B65D 81/22* (2013.01); *B65D 85/54* (2013.01); *B65D 75/522* (2013.01); *B65D 2203/045* (2013.01); *B65D 2571/00141* (2013.01); *B65D 2585/545* (2013.01)

(58) Field of Classification Search
USPC ..... 206/205
See application file for complete search history.

(56) References Cited

U.S. PATENT DOCUMENTS

| | | | | | |
|---|---|---|---|---|---|
| 4,691,820 | A * | 9/1987 | Martinez | B65D 75/326 | 206/205 |
| 4,787,509 | A * | 11/1988 | Pasternicki | B65D 71/16 | 206/427 |
| 5,060,800 | A * | 10/1991 | Bodet | B65D 85/72 | 156/285 |
| 5,697,495 | A * | 12/1997 | Abrams | B65B 25/008 | 134/901 |
| 5,743,402 | A | 4/1998 | Gics | | |
| 5,900,264 | A * | 5/1999 | Gics | B65D 81/3453 | 206/45.25 |
| 2003/0035868 | A1* | 2/2003 | Coulter | A23B 7/148 | 426/125 |
| 2005/0035023 | A1 | 2/2005 | Breu et al. | | |
| 2006/0219577 | A1* | 10/2006 | Newman | A45C 11/005 | 206/5.1 |
| 2010/0264058 | A1 | 10/2010 | Krause | | |
| 2011/0215016 | A1* | 9/2011 | Block | B65D 71/40 | 206/427 |
| 2013/0255195 | A1 | 10/2013 | Gasber | | |
| 2015/0114851 | A1* | 4/2015 | English | B65D 75/326 | 206/5.1 |

FOREIGN PATENT DOCUMENTS

| | | | |
|---|---|---|---|
| JP | S62-122969 | A | 6/1987 |
| JP | 2001-240119 | A | 9/2001 |
| JP | 2002-302179 | A | 10/2002 |
| JP | 2007-246102 | A | 9/2007 |
| JP | 2012-523999 | A | 10/2012 |
| JP | 2013-039944 | A | 2/2013 |
| JP | 2014-046953 | A | 3/2014 |
| JP | WO2013098870 | A1 | 4/2015 |
| WO | 02/098758 | A1 | 12/2002 |
| WO | 2004004930 | A1 | 1/2004 |
| WO | 2013/058713 | A1 | 4/2013 |
| WO | 2013109187 | A1 | 7/2013 |

OTHER PUBLICATIONS

International Preliminary Report On Patentability issued in corresponding International Patent Application No. PCT/GB2015/050996 dated Mar. 7, 2016 (with Response to WO filed Jan. 29, 2016 and Article 34 claims) (17 pages).

Office Action received in corresponding Japanese Patent Application No. 2016-560505 dated Mar. 27, 2017 with English translation (8 pages).

* cited by examiner

CONTACT LENS PACKAGING AND METHODS OF MANUFACTURING PACKAGED CONTACT LENSES

This application is a National Stage Application of PCT/GB2015/050996, filed Mar. 31, 2015, which claims the benefit under 35 U.S.C. § 119(e) of prior U.S. Provisional Patent Application No. 61/973,067, filed Mar. 31, 2014, which are incorporated in their entireties by reference herein.

FIELD

The present invention relates to contact lens packaging and methods, and more specifically, to packaging for sealed contact lens packs containing unworn contact lenses and methods of manufacturing packaged contact lenses.

BACKGROUND

Newly manufactured contact lenses are frequently packaged in contact lens blister packages or blister packs. For example, a newly manufactured contact lens will be placed in a cavity or bowl of a plastic base member of a contact lens blister package, a contact lens packaging solution will be provided in the blister package cavity, and a foil sealing member will be adhered to the blister package to hermetically seal the contact lens in the packaging solution in the cavity. In other words, a contact lens blister package used in the manufacture of contact lenses contains a base member having a cavity, an unworn contact lens provided in a packaging solution within the cavity, and a sealing member sealed to the base member to provide an air tight seal around the perimeter of the cavity. The blister packs are understood to be primary packaging. Multiple blister packs are then placed in cartons. The cartons are considered secondary packaging.

Because contact lenses are medical devices, it is important that information regarding the contact lenses is provided to help support healthcare and patient safety. This is accomplished by providing human-readable information, such as letters, numbers, and images, on the sealing member used to seal a contact lens blister pack. This human-readable information is typically preprinted on the sealing member prior to placement on the blister pack. Additional variable information, including machine readable information, such as bar codes, is then provided on cartons that contain multiple blister packs, each having an unworn contact lens.

It can be appreciated that there remains a need to improve contact lens packaging, which, among other things, maintains enough contact lens information to help improve healthcare and patient safety.

WO2013/109187 discloses a contact lens package assembly including a scalable primary lens package, at least one contact lens sealed within the primary lens package, and a scalable secondary lens package. The primary lens package is sealed within the secondary lens package to increase a shelf life of the at least one contact lens. The secondary lens package may be resealable. The secondary lens package may be configured to retain a plurality of primary lens packages. The contact lens package assembly may further include at least one inert gas sealed within the secondary lens package and outside of the primary lens package.

WO2004/004930 discloses a process and apparatus for automatically sorting and sequencing a random assemblage of products associated with a particular order for same. In one embodiment, the invention sequences the random products to match a predetermined label application sequence.

U.S. Pat. No. 5,743,402 discloses a food package for containing a food product. The food package includes a tray having a base with an outer surface and an inner surface and a sidewall extending from the base. The sidewall has outer surface and an inner surface and defines a tray opening. A sleeve is provided which includes (i) a bottom section disposed adjacent the outer surface of the base; (ü) a side section disposed adjacent the outer surface of the sidewall; and (iii) a top section secured to the sidewall and substantially covering the tray opening. In another embodiment, a plastic film is interposed between the tray and the sleeve EP1270441 discloses a packaging structure having at least one carrier section for the contents with a bonded protective shrouding, a base and a lid to form a carton. The carrier is hinged to the shrouding, to give a flap action between a stowed rest position between the base and lid and an open access position. The base and lid are component parts of the carton, with its four side walls at right angles to the base. One side wall forms a hinge strip, so that the carrier section has a swing movement at the hinge strip, and the butting side walls are stabilized at least in the rest position. The carrier section holds a blister film, with the contained pills or capsules welded and sealed in place.

US2013/255195 discloses a method for the secondary packaging of ophthalmic lenses, for example contact lenses, contained in individual primary packages. The method included steps of providing a plurality of single individual primary packages each containing a lens and determining a number of single individual primary packages to be taken from the plurality of single individual primary packages and to be packed into a secondary package. The method further includes the steps of providing a secondary package blank of a size capable of accommodating the determined number of single individual primary packages to be packed into the secondary package and placing each single individual primary package of the determined number of single individual primary packages into the secondary package blank. The method further includes the step of folding and closing the secondary package blank containing the determined number of single individual primary packages to form the secondary package.

SUMMARY

The present invention addresses this need. As discussed herein, new contact lens packaging and methods of manufacturing packaged contact lenses are described which enable both machine readable information and human readable information to be provided on a package for a single contact lens. In other words, both machine readable and human readable information can now be provided for individual packaged contact lenses as compared to relying on the combination of cartons containing multiple packaged contact lenses and the individual contact lens packages. This was previously not possible because the sealing members of the individual blister packages were too small to contain both human readable and machine readable information as may be required by regulatory agencies. Thus, it will now be possible to provide individual packaged contact lenses to eye care practitioners (ECPs), contact lens wearers, and the like, while still complying with regulatory agency requirements to provide a unique device identifier (UDI) in both a plain text form and in a form that uses automatic identification and data capture (AIDC) technology. Individual lenses include, among other things, contact lenses that may be part of a trial set or fitting set; for example, the individual lenses may be replacement lenses for a fitting set for an ECP or the individual packaged lenses may be the lenses of the initial fitting set of the ECP. If desired, these individually packaged contact lenses, as described in more detail herein, may be provided in cartons as well to provide contact lens multi-packs.

In general, as described herein, a contact lens package is provided. The contact lens package so described includes a plastic base member and a sealing member coupled to the base member to seal a contact lens in a cavity formed between the plastic base member and the sealing member. An unworn contact lens is provided in a contact lens packaging solution in the cavity. This sealed device is referred to herein as a sealed contact lens package or sealed contact lens blister pack. The present contact lens package also includes a wrap that has one or more panels. The wrap is dimensioned to accommodate the sealed contact lens package and to also provide a UDI in both human readable form and machine readable form, in addition to other required regulatory information. Thus, the wrap includes human readable information, such as letters, numbers, and images; and the wrap includes machine readable information, such as bar codes and the like. The wrap can be flexible or rigid, and as described herein, does not need to fully enclose or surround the individual sealed contact lens package. The wrap is coupled to the sealed contact lens package so that the wrap and sealed contact lens package do not become separated until a person opens the package to remove the unworn contact lens. For example, the wrap may be adhered to the sealed contact lens package, such as by using an adhesive between a surface of the wrap and a surface of the sealing member, or the wrap may be physically wrapped around the sealed contact lens package to mechanically enclose the sealed contact lens package within the wrap. Thus, the wrap cannot be inadvertently dislodged or separated from the sealed contact lens package. In some embodiments, it can be understood that a single contact lens package in accordance with the present disclosure comprises, consists essentially of, or consist of a sealed contact lens package containing an unworn contact lens and a wrap having human readable and computer readable information corresponding to the contact lens coupled or affixed to the sealed contact lens package. Therefore, each individual sealed contact lens package has a single wrap that contains a UDI that includes human readable information and machine readable information in addition to other information required by regulatory agencies. The present contact lens packages (i.e., sealed contact lens package and wrap) are dimensioned to fit within individual lens package slots of contact lens fitting sets or trial sets cases used in ECP offices. In addition, the present contact lens packages are also dimensioned to fit within multi-pack cartons, such as a carton dimensioned to contain three sealed contact lens packages.

In one aspect of the invention, a contact lens package is provided. The contact lens package includes a sealed contact lens package and a wrap coupled to the sealed contact lens package. The sealed contact lens package includes a base member, and a sealing member coupled to the base member to provide a sealed cavity. An unworn contact lens is provided in a contact lens packaging solution within the sealed cavity. The wrap includes at least one panel that includes a printing surface. The printing surface includes a unique device identifier in both a human readable form including numbers or letters, or combinations thereof, and a machine readable form including a barcode.

In another aspect of the invention, a method of manufacturing a contact lens package is provided. The method includes a step of providing a sealed contact lens package, where the sealed contact lens package includes a base member, a sealing member coupled to the base member to provide a cavity, and an unworn contact lens provided in a contact lens packaging solution within the cavity. The method also includes a step of coupling a wrap to the sealed contact lens package, where the wrap includes at least one panel that includes a printed surface including a unique device identifier in both human readable form comprising numbers, or letters, or combinations thereof, and machine readable form comprising a barcode.

Other aspects and details of the present invention will be apparent based on the following drawings, detailed description, and claims.

DETAILED DESCRIPTION

The present contact lens packages include a plastic base member and a sealing member coupled to the base member to seal a contact lens in a cavity formed between the plastic base member and the sealing member. As used herein, the terms including and comprising are used synonymously and are open ended terms that do not preclude additional features unless specifically excluded. For purposes of convenience, the following description will focus on describing a single contact lens package for a single contact lens; however, it will be understood that the present disclosure can apply to multiple contact lens packages for multiple contact lenses. An unworn contact lens is provided in a contact lens packaging solution in the cavity to provide a sealed contact lens package or a sealed contact lens blister pack.

Figure 60:
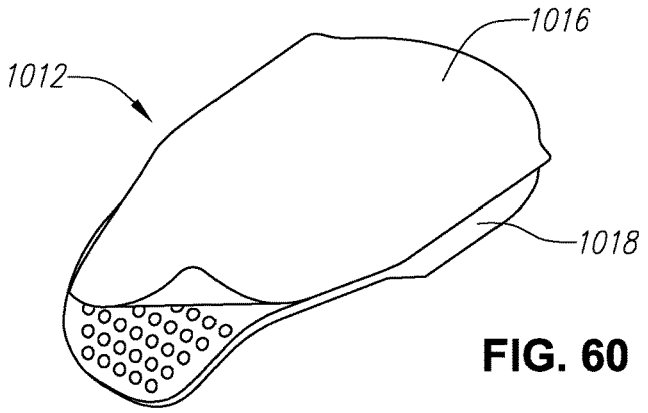
FIG. 60 is a perspective view of a sealed contact lens package.
Figure 61:
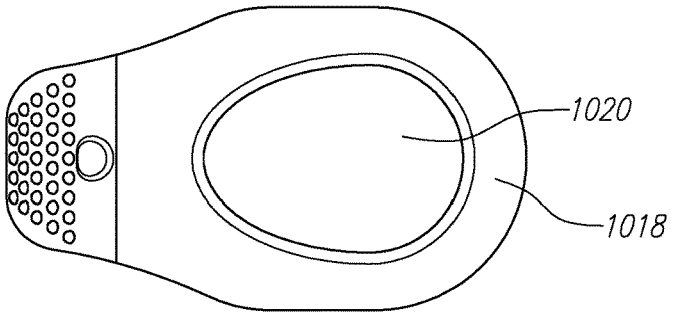
FIG. 61 is a perspective view of the sealed contact lens package of FIG. 60 with the sealing member removed illustrating the base member.
Figure 62:
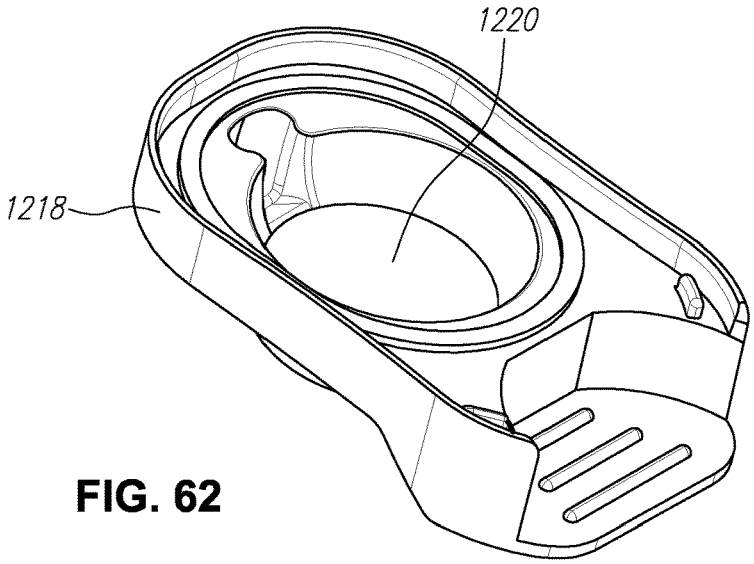
FIG. 62 is a perspective view of another base member of another contact lens package.

One example of a sealed contact lens package useful in the present contact lens packages is illustrated in FIG. 60. The sealed contact lens package 1012 of FIG. 60 includes a sealing member 1016 coupled to a plastic base member 1018. The plastic base member 1018 is illustrated in FIG. 61 with the sealing member 1016 removed from the base member. Another example sealed contact lens package (without the sealing member illustrated) is shown in FIG. 62. The plastic base member 1118 has a cavity 1120, and a sealing member is provided around the perimeter of the cavity 1120 to hermetically seal an unworn contact lens in the cavity. In addition, other conventional sealed contact lens packages can be used in the present contact lens packages described herein. Examples of sealed contact lens packages useful in the present invention include those described in the following: U.S. Pat. Nos. 6,398,018; 7,426,993; 7,477,366; US20120061260 and WO2013160667.

An unworn contact lens is sealed within the cavity of the sealed contact lens package and is packaged in a contact lens packaging solution. Any contact lens can be packaged therein. For example, the contact lens can be a hydrogel contact lens or it can be a silicone hydrogel contact lens. Examples of contact lenses that can be provided in the packages include those having the following United States Adopted Names (USANs): methafilcon A, ocufilcon A, ocufilcon B, ocufilcon C, ocufilcon D, omafilcon A, omafilcon B, comfilcon A, enfilcon A, stenfilcon A, etafilcon A, senofilcon A, narafilcon A, narafilcon B, balafilcon A, samfilcon A, lotrafilcon A, lotrafilcon B, somofilcon A, delefilcon A, and the like. The contact lens packaging solution is typically a buffered saline solutions, such as a phosphate buffered saline solution or a borate buffered saline solution, that may contain one or more additives, such as surfactants, wetting agents, viscosity agents, and the like.

The present contact lens package also includes a wrap that has one or more panels. The wrap is dimensioned to accommodate the sealed contact lens package and to also provide a UDI in both human readable form and machine readable form, in addition to other required regulatory information. As used herein, a wrap refers to a substrate or article comprising one or more panels coupled to a sealed contact lens package, and a UDI in both human readable form and machine readable form is provided on at least one of the panels. This wrap may be understood to be a "UDI wrap", or it may be understood to be a wrap having a "UDI panel". Thus, the wrap includes human readable information, such as letters, numbers, and images; and the wrap includes machine readable information, such as bar codes and the like. The wrap can be flexible or rigid, and as described herein, does not need to fully enclose or surround the individual sealed contact lens package. The wrap is coupled to the sealed contact lens package so that the wrap and sealed contact lens package do not become separated until a person opens the package to remove the unworn contact lens. For example, the wrap may be adhered to the sealed contact lens package, such as by using an adhesive between a surface of the wrap and a surface of the sealing member, or the wrap may be physically wrapped around the sealed contact lens package to mechanically enclose the sealed contact lens package within the wrap. Thus, the wrap cannot be inadvertently dislodged or separated from the sealed contact lens package. In some embodiments, it can be understood that a single contact lens package in accordance with the present disclosure comprises, consists essentially of, or consists of a sealed contact lens package containing an unworn contact lens and a wrap having human readable and computer readable information corresponding to the contact lens coupled or affixed to the sealed contact lens package. Therefore, each individual sealed contact lens package has a single wrap that contains a UDI that includes human readable information and machine readable information in addition to other information required by regulatory agencies. The present contact lens packages (i.e., sealed contact lens package and wrap) are dimensioned to fit within individual lens package slots of contact lens fitting sets or trial sets cases used in ECP offices. In addition, the present contact lens packages are also dimensioned to fit within multi-pack cartons, such as a carton dimensioned to contain three sealed contact lens packages.

It can therefore be understood that one aspect of the present disclosure relates to a contact lens package. A contact lens package includes a sealed contact lens package and a wrap (i.e., a UDI wrap) coupled to the sealed contact lens package. The sealed contact lens package includes a base member, and a sealing member coupled to the base member to provide a sealed cavity. An unworn contact lens, such as a hydrogel or silicone hydrogel contact lens, is provided in a contact lens packaging solution within the cavity. The wrap (UDI wrap) includes one or more panels. One or more of the panels includes a printing surface that includes a unique device identifier (UDI) in both human readable form and machine readable form. The human readable form includes numbers or letters, or combinations of numbers and letters. The machine readable form includes a barcode (such as one or more barcodes). It can therefore be understood that on a single panel a human readable UDI and a machine readable UDI is provided.

As stated above, the base member of the sealed contact lens package can be a variety of structures, such as a relatively rigid material or a flexible material. In some embodiments of the present packages, including the illustrated embodiments, the base member of the sealed contact lens package is a thermoplastic material and the base member includes a cavity and a substantially planar surface surrounding the cavity. The substantially planar surface provides a sealing surface for the sealing member. The base member can be made from a variety of materials. In the illustrated embodiments, the base member is a polyolefin material. Preferably, the base member comprises a polypropylene material. The base member is formed using conventional methods and equipment, such as by injection molding polypropylene resin into base member molds in an injection molding machine. The sealing member can also be formed by a variety of materials. For example, the sealing member can be a laminated structure comprising a foil and one or more layers of plastic, such as polypropylene and the like. The sealing member can include some human readable information, as desired. The sealing member is coupled to the base member by contacting the sealing surface of the base member with the sealing member and applying heat to fuse the two members together to provide a hermetic or airtight seal for the contact lens in the packaging solution in the cavity.

In certain embodiments, including some of the illustrated embodiments, the wrap includes an adhesive to adhere the wrap to the sealing member of the sealed contact lens package.

Reference will now be made to the illustrated embodiments of the present contact lens packages, as shown in the accompanying drawings.

FIGS. 1-6 illustrate a first embodiment of the present contact lens packages.

Figure 1:
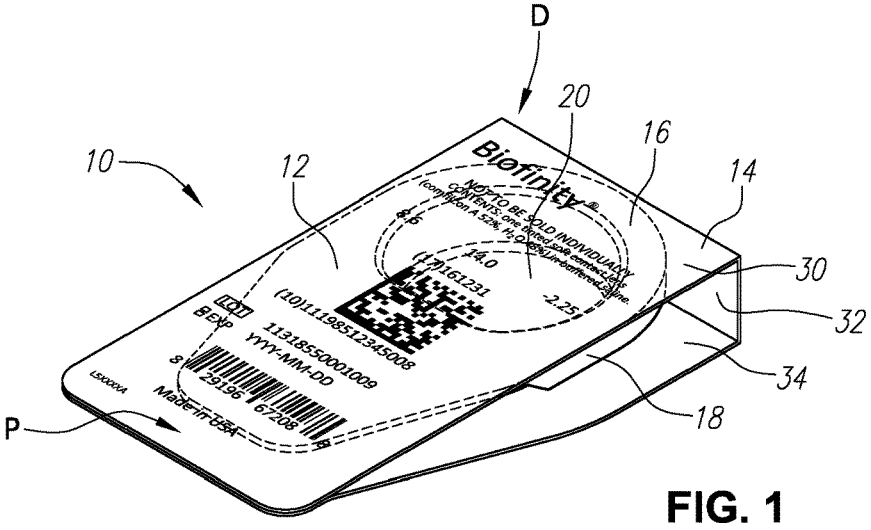
FIG. 1 is a perspective view of a contact lens package having a three-paneled wrap.
Figure 2:
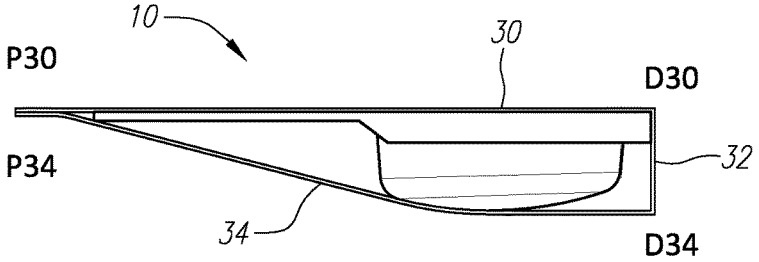
FIG. 2 is a side plan view of the contact lens package of FIG. 1.

FIG. 1 illustrates a contact lens package 10 includes a sealed contact lens package 12 and a wrap (UDI wrap) 14 coupled to the sealed contact lens package 12. The base member 18 includes a cavity 20, which is hermetically sealed by a sealing member 16. (The details of the sealing member are not illustrated in the majority of the drawings for convenience, but reference can be made to FIG. 60 to understand the relationship between the sealing member and the base member). A contact lens, such as a hydrogel or silicone hydrogel contact lens (not shown), is provided in the cavity 20. Also shown in FIG. 1 is that the contact lens package 10 has a proximal end P and a distal end D, which corresponds to the proximal end and distal end of the sealed contact lens package, respectively. Stated differently, the proximal end refers to the portion of the base member that has a finger or thumb grip, and the distal end refers to the portion of the base member on the opposite end. The wrap 14 is illustrated as including three panels, a first panel 30, a second panel 32, and a third panel 34. The panel arrangement is also shown in FIG. 2. In this embodiment, the wrap can be made from card stock or other similarly rigid material, or it can be made from flexible plastic materials, such as polypropylene films.

In FIG. 2, the first panel 30 is illustrated, and the first panel 30 has an adhesive surface. The adhesive surface is adhered to the sealing member of the sealed contact lens package. As shown in FIG. 2, the first panel has a proximal end P30 and a distal end D30. The proximal end P30 is adjacent to the proximal end P of the sealed contact lens package. The distal end D30 is adjacent the distal end of the sealed contact lens package. The second panel 32 extends from the distal end of the first panel. The third panel 34 also includes a proximal end P34 and a distal end D34. The distal end D34 is adjacent the second panel 32.

Figure 3:
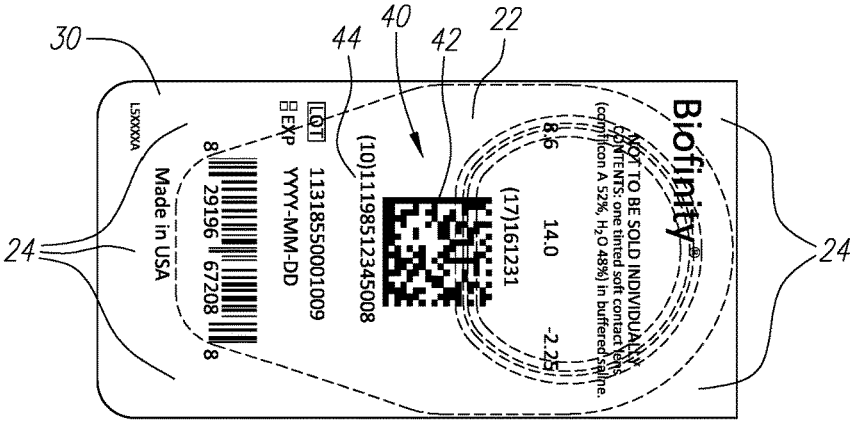
FIG. 3 is a top plan view of the contact lens package of FIG. 1.

FIG. 3 provides a top plan view of the contact lens package of FIG. 1 and FIG. 2. FIG. 3 illustrates one pattern of how adhesive is provided on the first panel 30. It is shown that the first panel 30 has an active adhesive region 22 and a deadened adhesive region 24. The active adhesive region 22 overlays substantially all of the surface of the sealing member, and the deadened adhesive region 24 is made to not adhere and is provided in one or more regions around the perimeter of the sealing member. With such an arrangement, it is possible to ensure that the first panel 30 is removed with the sealing member when a person desires to open the sealed contact lens package to access the unworn contact lens. Preferably, the adhesive is a permanent adhesive, and a variety of adhesives can be used to couple the first panel to the sealing member. In certain embodiments, the adhesive is an acrylic adhesive. Acrylic adhesives can be obtained from companies such as Manter (Spain) or UPM Raflatac, Inc. (North Carolina, US), and the like. It will be understood that for the other embodiments described herein, when an adhesive is provided to couple the UDI wrap to the sealed contact lens package, the same adhesives can be used as described for this embodiment of FIGS. 1-6.

In view of the discussion above, and as shown in FIG. 3, embodiments of the present contact lens packages can include a UDI wrap having a first panel that has a perimeter, and the adhesive surface includes an active adhesive portion having the same shape as the shape of the sealing member of the sealed contact lens package, and the adhesive surface includes a deadened adhesive portion disposed between the active adhesive portion and the perimeter of the first panel.

As shown in the embodiment illustrated in FIG. 2, embodiments of the present packages have first panels and third panels that have proximal end edges, and the proximal end edge of the third panel is aligned with the proximal end edge of the first panel.

FIG. 3 also illustrates the UDI 40 that is provided on the first panel 30. The UDI 40 is a unique device identifier that is provided in both a human readable form 44, such as text or numbers, and a machine readable form 42, such as a bar code. In addition, other information can be provided on the first panel 30 in addition to the UDI 40, such as other text, numbers, or graphics, and other bar codes.

Figure 4:
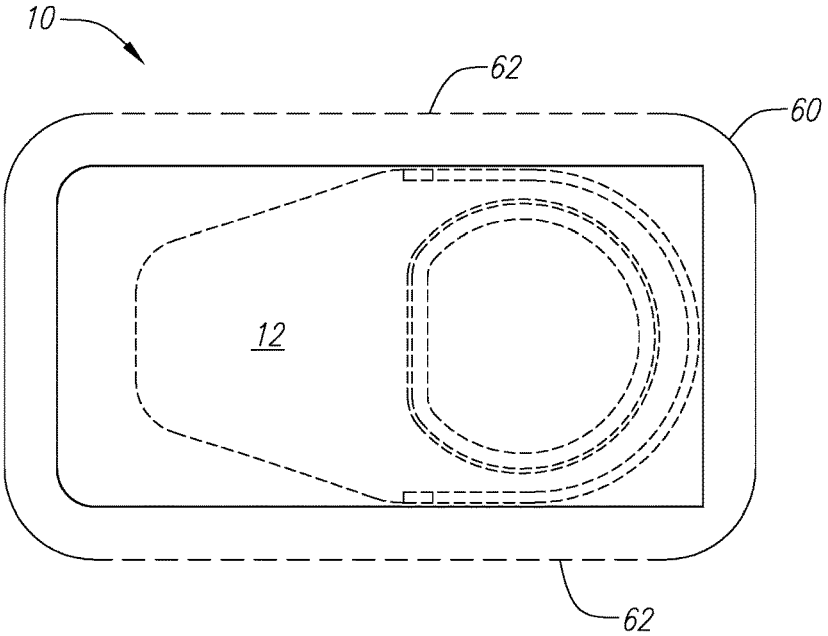
FIG. 4 is a bottom plan view of the contact lens package of FIG. 1 in a shrink sleeve.

FIG. 4 provides a bottom plan view of the contact lens package 10 of FIG. 1. However, a further element 60 is depicted enclosing the contact lens package 10. The element 60 is a shrink wrap or shrink sleeve that extends around the UDI wrap that is adhered to the sealed contact lens package. The shrink sleeve 60 includes perforated segments 62, which are illustrated along the side of the contact lens package. The perforated segments 62 facilitate opening of the shrink sleeve 60. The shrink sleeve 60 is illustrated roughly in FIG. 4, but in practice, the sleeve will form a relatively tight fit over the contact lens package, and will not add substantially to the dimensions of the contact lens package without the sleeve.

In addition, the shrink sleeve can provide protection to the information contained on the first panel by preventing the information from being rubbed or worn off. The shrink sleeve can also help reduce particulate contamination with the sealed contact lens package during handling and distribution. The shrink sleeve described for FIG. 4, and the shrink sleeves described further herein, can be made of any conventional material. For example, the shrink sleeves used with the present contact lens packages can be made from biaxially oriented polypropylene (BOPP). The shrink sleeves can be clear or colored, and can also include printing, such as text, numbers, or graphical images.

Figure 5:
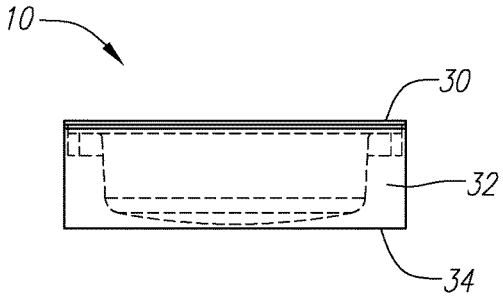
FIG. 5 is a front plan view of the contact lens package of FIG. 1.
Figure 6:
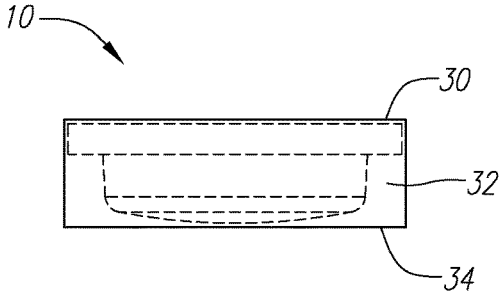
FIG. 6 is a rear plan view of the contact lens package of FIG. 1.

FIG. 5 illustrates a front plan view of the contact lens package 10 of FIG. 1. FIG. 6 illustrates a rear plan view of the contact lens package of FIG. 1.

In some embodiments, a contact lens package is as described above, and the wrap includes a first panel having an adhesive surface. The adhesive surface is adhered to the sealing member. The first panel has a proximal end adjacent to a proximal end of the sealed contact lens package and a distal end adjacent to a distal end of the sealed contact lens package. The wrap also includes a second panel extending from the distal end of the first panel; and a third panel including a proximal end and a distal end and the distal end is adjacent the second panel.

As described for FIG. 4, some of the embodiments of the above-described contact lens package may include a shrink sleeve extending around the wrap that is adhered to the sealed contact lens package. In further embodiments, the shrink sleeve can include one or more perforated segments that are effective in opening of the shrink sleeve.

In still further embodiments, it can be understood that the first panel has a perimeter, and the adhesive surface includes an active adhesive portion having the same shape as the shape of the sealing member, and the first panel includes a deadened adhesive portion, or non-adhesive portion, disposed between the active adhesive portion and the perimeter of the first panel.

FIGS. 7-12 illustrate a second embodiment of the present contact lens packages.

Figure 7:
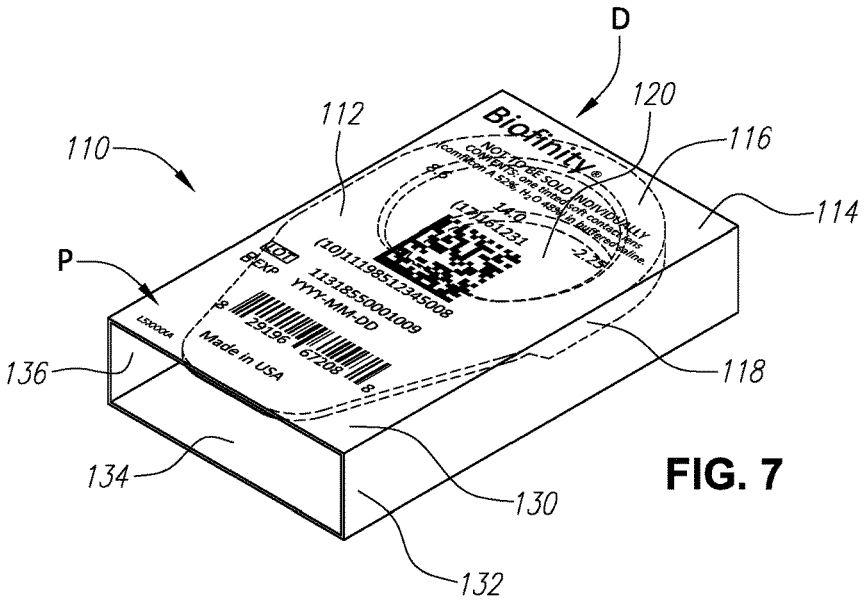
FIG. 7 is a perspective view of a contact lens package having a four-paneled wrap.

FIG. 7 illustrates a contact lens package 110 includes a sealed contact lens package 112 and a wrap (UDI wrap) 114 coupled to the sealed contact lens package 112. The base member 118 includes a cavity 120, which is hermetically sealed by a sealing member 116. A contact lens, such as a hydrogel or silicone hydrogel contact lens (not shown), is provided in the cavity 120. Also shown in FIG. 7 is that the contact lens package 110 has a proximal end P and a distal end D, which corresponds to the proximal end and distal end of the sealed contact lens package, respectively. Stated differently, the proximal end refers to the portion of the base member that has a finger or thumb grip, and the distal end refers to the portion of the base member on the opposite end. The wrap 114 is illustrated as including four panels, a first panel 130, a second panel 132, a third panel 134, and a fourth panel 136. Instead of wrapping the panels around the distal end of the sealed contact lens package, in the embodiment of FIG. 7, the panels are wrapped around the sides of the sealed contact lens package thereby providing a proximal end opening and a distal end opening. In this embodiment, the wrap 114 is made of card stock or other similarly rigid material.

Figure 8:
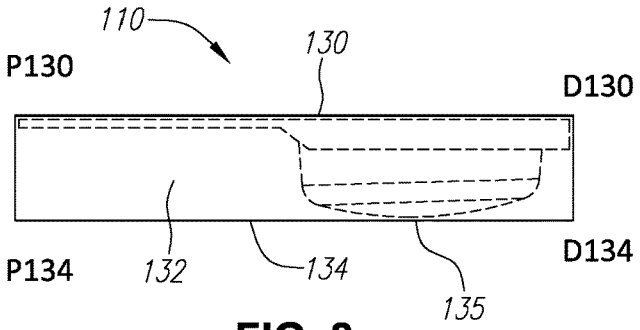
FIG. 8 is a side plan view of the contact lens package of FIG. 7.

In FIG. 8, the third panel 134 has an adhesive surface. The adhesive surface is adhered to the base member of the sealed contact lens package, such as at location 135. As shown in FIG. 8, the first panel has a proximal end P130 and a distal end D130. The proximal end P130 is adjacent to the proximal end P of the sealed contact lens package. The distal end D130 is adjacent the distal end of the sealed contact lens package. The second panel 132 extends from the right side of the first panel. The third panel 134 also includes a proximal end P134 and a distal end D134. A fourth panel 136 is provided connecting the third panel 134 to the first panel 130.

Figure 9:
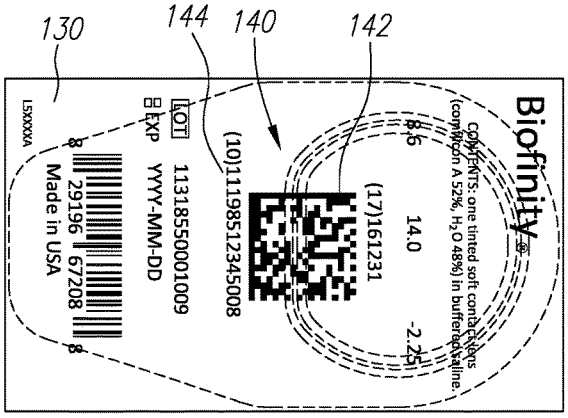
FIG. 9 is a top plan view of the contact lens package of FIG. 7.

FIG. 9 provides a top plan view of the contact lens package of FIG. 7 and FIG. 8. FIG. 9 also illustrates the UDI 140 that is provided on the first panel 130. The UDI 140 is a unique device identifier that is provided in both a human readable form 144, such as text or numbers, and a machine readable form 142, such as a bar code. In addition, other information can be provided on the first panel 130 in addition to the UDI 140, such as other text, numbers, or graphics, and other bar codes.

Figure 10:
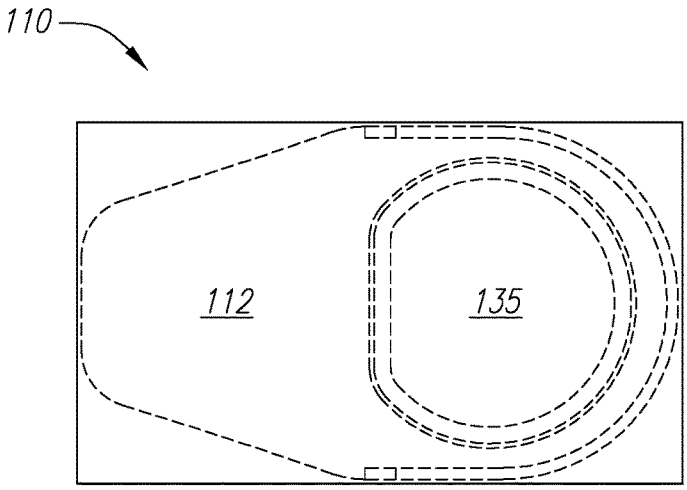
FIG. 10 is a bottom plan view of the contact lens package of FIG. 7.

FIG. 10 provides a bottom plan view of the contact lens package 110 of FIG. 7. The adhesive region 135 is illustrated as coupling the third panel 134 to the base member 112 at a region near the outer bottom surface of the cavity.

Figure 11:
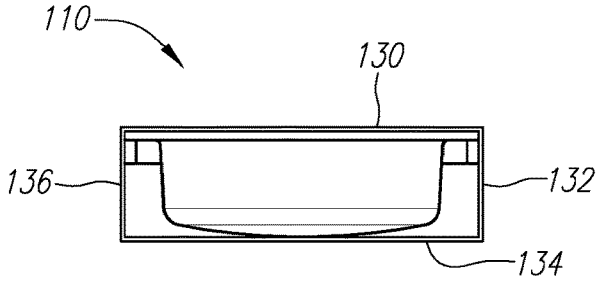
FIG. 11 is a front plan view of the contact lens package of FIG. 7.
Figure 12:
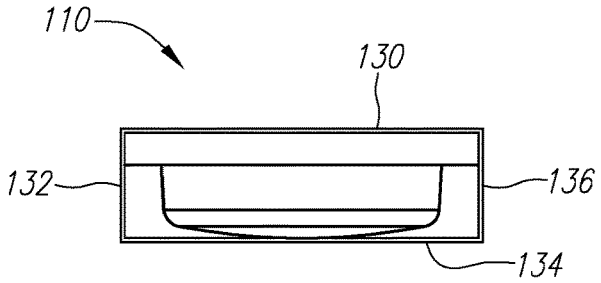
FIG. 12 is a rear plan view of the contact lens package of FIG. 7.

FIG. 11 illustrates a front plan view of the contact lens package 110 of FIG. 7. FIG. 12 illustrates a rear plan view of the contact lens package of FIG. 7.

Although not shown, similar to the embodiment of FIGS. 1-6, a shrink sleeve can be provided around the UDI wrap 130 of the contact lens package 110.

FIGS. 13-18 illustrate a third embodiment of the present contact lens packages.

Figure 13:
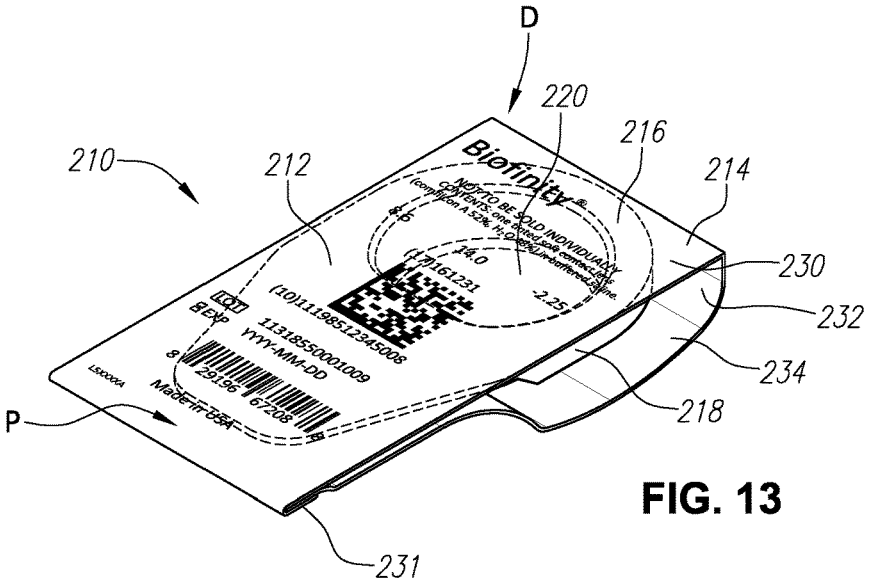
FIG. 13 is a perspective view of a contact lens package having a four-paneled wrap.
Figure 14:
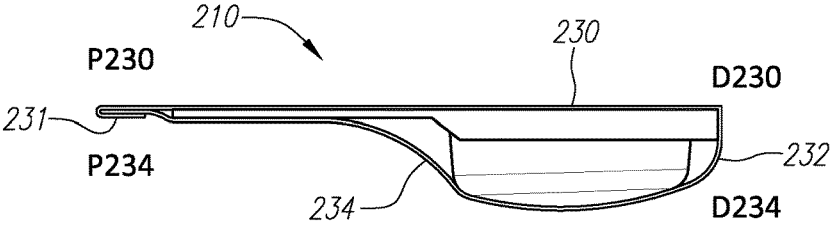
FIG. 14 is a side plan view of the contact lens package of FIG. 13.

FIG. 13 illustrates a contact lens package 210 includes a sealed contact lens package 212 and a wrap (UDI wrap) 214 coupled to the sealed contact lens package 212. The base member 218 includes a cavity 220, which is hermetically sealed by a sealing member 216. (The details of the sealing member are not illustrated in the majority of the drawings for convenience, but reference can be made to FIG. 60 to understand the relationship between the sealing member and the base member). A contact lens, such as a hydrogel or silicone hydrogel contact lens (not shown), is provided in the cavity 220. Also shown in FIG. 13 is that the contact lens package 210 has a proximal end P and a distal end D, which corresponds to the proximal end and distal end of the sealed contact lens package, respectively. Stated differently, the proximal end refers to the portion of the base member that has a finger or thumb grip, and the distal end refers to the portion of the base member on the opposite end. The wrap 214 is illustrated as including four panels, a first panel 230, a second panel 232, a third panel 234, and a fourth panel 231. The panel arrangement is also shown in FIG. 14. In this embodiment, the wrap can be made from card stock or other similarly rigid material, or it can be made from flexible plastic materials, such as polypropylene films.

In FIG. 14, the first panel 230 is illustrated, and the first panel 230 has an adhesive surface. The adhesive surface is adhered to the sealing member of the sealed contact lens package. As shown in FIG. 14, the first panel has a proximal end P230 and a distal end D230. The proximal end P230 is adjacent to the proximal end P of the sealed contact lens package. The distal end D230 is adjacent the distal end of the sealed contact lens package. The second panel 232 extends from the distal end of the first panel. The third panel 234 also includes a proximal end P234 and a distal end D234. The distal end D324 is adjacent the second panel 232. Fourth panel 231 is illustrated as being connected to the proximal end P230 of the first panel 230 and overlaying the proximal end P234 of third panel 234. In addition, a tab or other similar element can be provided near the proximal end of the contact lens package; the tab is effective in facilitation separating the sealing member from the base member, as the sealing member is attached to the first panel of the UDI wrap 214.

Figure 15:
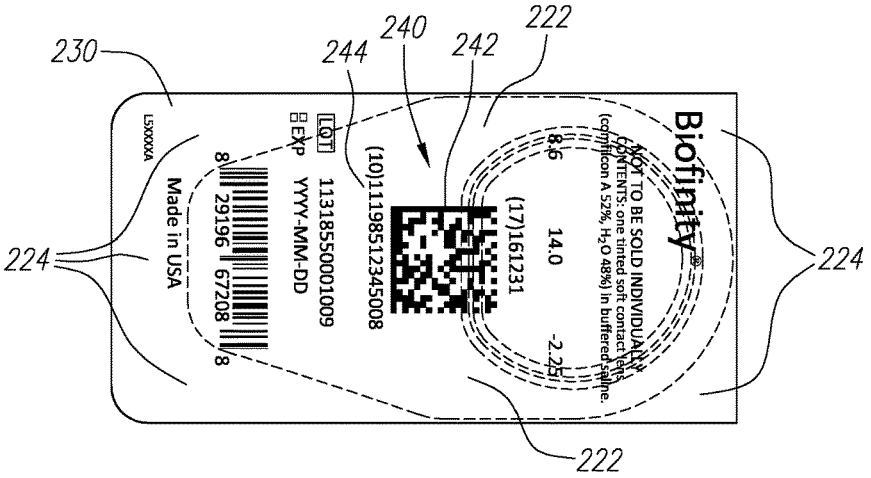
FIG. 15 is a top plan view of the contact lens package of FIG. 13.

FIG. 15 provides a top plan view of the contact lens package of FIG. 13 and FIG. 14. FIG. 15 illustrates one pattern of how adhesive is provided on the first panel 230. It is shown that the first panel 230 has an active adhesive region 222 and a deadened adhesive region 224. The active adhesive region 222 overlays substantially all of the surface of the sealing member, and the deadened adhesive region 224 is made to not adhere and is provided in one or more regions around the perimeter of the sealing member. With such an arrangement, it is possible to ensure that the first panel 230 is removed with the sealing member when a person desires to open the sealed contact lens package to access the unworn contact lens. Preferably, the adhesive is a permanent adhesive, and a variety of adhesives can be used to couple the first panel to the sealing member. In certain embodiments, the adhesive is an acrylic adhesive, such as those described above.

In view of the discussion above, and as shown in FIG. 15, embodiments of the present contact lens packages can include a UDI wrap having a first panel that has a perimeter, and the adhesive surface includes an active adhesive portion having the same shape as the shape of the sealing member of the sealed contact lens package, and the adhesive surface includes a deadened adhesive portion disposed between the active adhesive portion and the perimeter of the first panel.

As shown in the embodiment illustrated in FIG. 14, embodiments of the present packages have first panels and third panels that have proximal end edges, and the proximal end edge of the third panel is aligned with the proximal end edge of the first panel.

FIG. 15 also illustrates the UDI 240 that is provided on the first panel 230. The UDI 240 is a unique device identifier that is provided in both a human readable form 244, such as text or numbers, and a machine readable form 242, such as a bar code. In addition, other information can be provided on the first panel 230 in addition to the UDI 240, such as other text, numbers, or graphics, and other bar codes.

Figure 16:
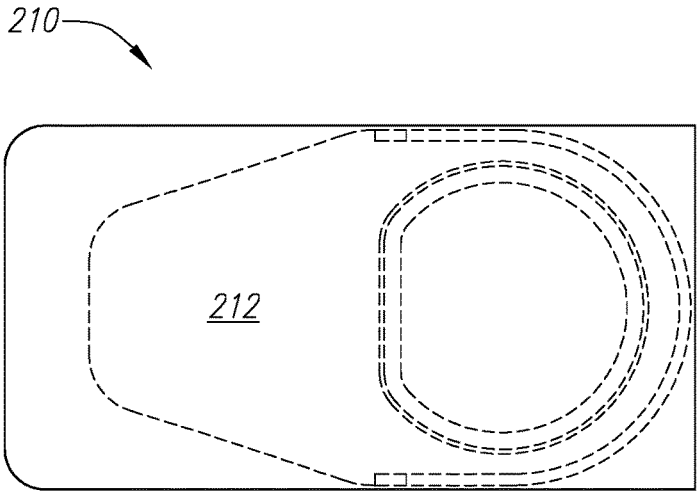
FIG. 16 is a bottom plan view of the contact lens package of FIG. 13.

FIG. 16 provides a bottom plan view of the contact lens package 210 of FIG. 13. As described with respect to FIG. 4, the contact lens package 210 can include a shrink wrap or shrink sleeve that extends around the UDI wrap that is adhered to the sealed contact lens package. The shrink sleeve can include perforated segments along the side of the contact lens package. The perforated segments facilitate opening of the shrink sleeve. The shrink sleeve will form a relatively tight fit over the contact lens package, and will not add substantially to the dimensions of the contact lens package without the sleeve.

In addition, the shrink sleeve can provide protection to the information contained on the first panel by preventing the information from being rubbed or worn off. The shrink sleeve can also help reduce particulate contamination with the sealed contact lens package during handling and distribution.

Figure 17:
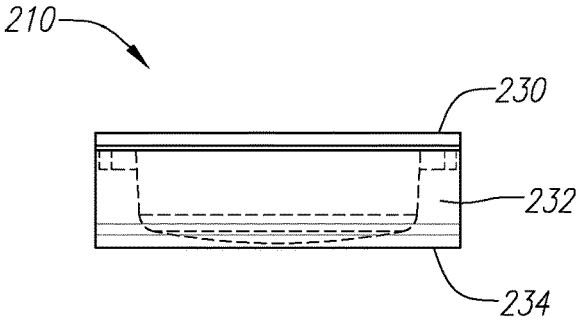
FIG. 17 is a front plan view of the contact lens package of FIG. 13.
Figure 18:
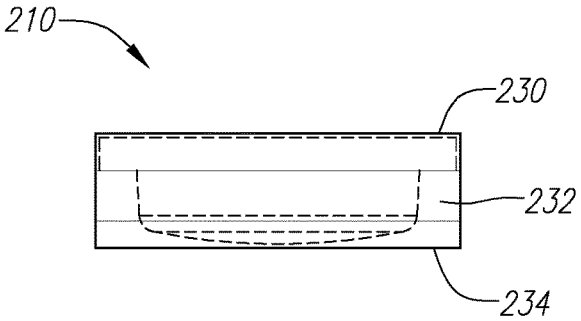
FIG. 18 is a rear plan view of the contact lens package of FIG. 13.

FIG. 17 illustrates a front plan view of the contact lens package 210 of FIG. 13. FIG. 18 illustrates a rear plan view of the contact lens package of FIG. 13.

In view of the description of the embodiment of FIGS. 13-18, it can be understood that some embodiments have a first panel with a proximal end edge and a third panel with a proximal end edge, and the proximal end edge of the first panel of the wrap overlays the proximal end edge of the third panel wrap.

FIGS. 19-24 illustrate a fourth embodiment of the present contact lens packages.

Figure 19:
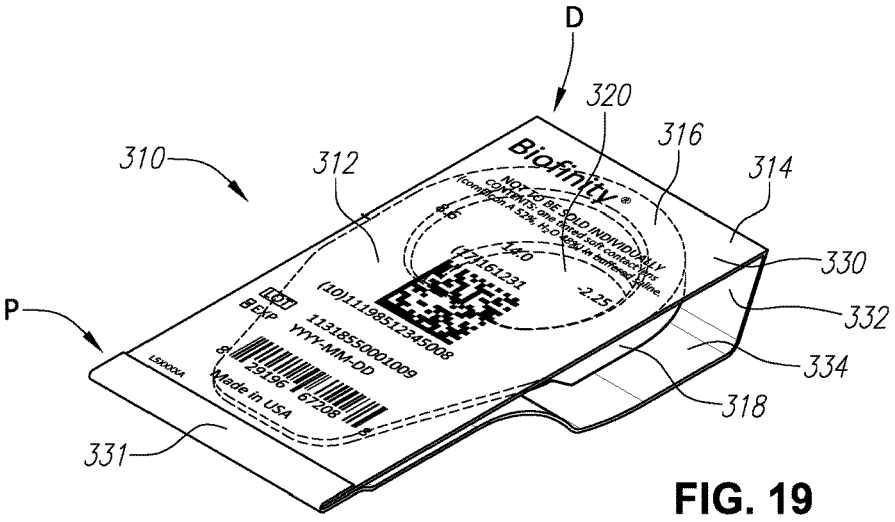
FIG. 19 is a perspective view of a contact lens package having a four-paneled wrap.
Figure 20:
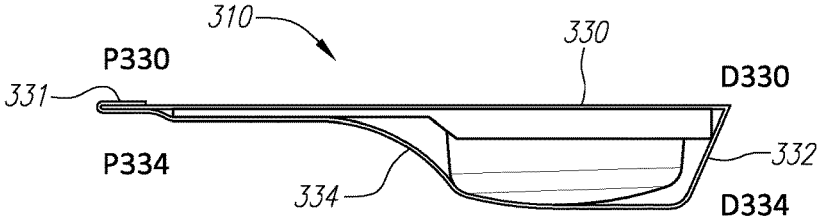
FIG. 20 is a side plan view of the contact lens package of FIG. 19.

FIG. 19 illustrates a contact lens package 310 includes a sealed contact lens package 312 and a wrap (UDI wrap) 314 coupled to the sealed contact lens package 312. The base member 318 includes a cavity 320, which is hermetically sealed by a sealing member 316. (The details of the sealing member are not illustrated in the majority of the drawings for convenience, but reference can be made to FIG. 60 to understand the relationship between the sealing member and the base member). A contact lens, such as a hydrogel or silicone hydrogel contact lens (not shown), is provided in the cavity 320. Also shown in FIG. 19 is that the contact lens package 310 has a proximal end P and a distal end D, which corresponds to the proximal end and distal end of the sealed contact lens package, respectively. Stated differently, the proximal end refers to the portion of the base member that has a finger or thumb grip, and the distal end refers to the portion of the base member on the opposite end. The wrap 314 is illustrated as including four panels, a first panel 330, a second panel 332, a third panel 334, and a fourth panel 331. The panel arrangement is also shown in FIG. 20. In this embodiment, the wrap can be made from card stock or other similarly rigid material, or it can be made from flexible plastic materials, such as polypropylene films.

In FIG. 20, the first panel 330 is illustrated, and the first panel 330 has an adhesive surface. The adhesive surface is adhered to the sealing member of the sealed contact lens package. As shown in FIG. 20, the first panel has a proximal end P330 and a distal end D330. The proximal end P330 is adjacent to the proximal end P of the sealed contact lens package. The distal end D330 is adjacent the distal end of the sealed contact lens package. The second panel 332 extends from the distal end of the first panel. The third panel 334 also includes a proximal end P334 and a distal end D334. The distal end D334 is adjacent the second panel 332. Fourth panel 331 is illustrated as being connected to the proximal end P334 of the third panel 334 and overlaying the proximal end P330 of first panel 330.

Figure 21:
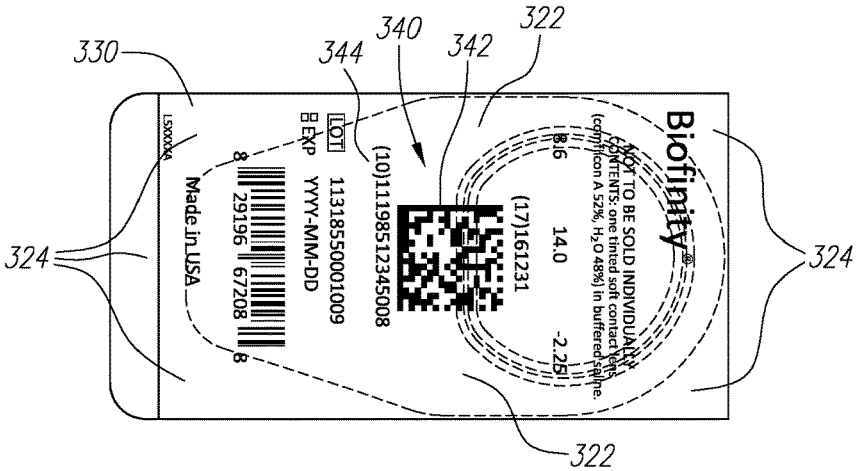
FIG. 21 is a top plan view of the contact lens package of FIG. 19.

FIG. 21 provides a top plan view of the contact lens package of FIG. 19 and FIG. 20. FIG. 21 illustrates one pattern of how adhesive is provided on the first panel 330. It is shown that the first panel 330 has an active adhesive region 322 and a deadened adhesive region 324. The active adhesive region 322 overlays substantially all of the surface of the sealing member, and the deadened adhesive region 324 is made to not adhere and is provided in one or more regions around the perimeter of the sealing member. With such an arrangement, it is possible to ensure that the first panel 330 is removed with the sealing member when a person desires to open the sealed contact lens package to access the unworn contact lens. Preferably, the adhesive is a permanent adhesive, and a variety of adhesives can be used to couple the first panel to the sealing member. In certain embodiments, the adhesive is an acrylic adhesive, such as those described above.

In view of the discussion above, and as shown in FIG. 21, embodiments of the present contact lens packages can include a UDI wrap having a first panel that has a perimeter, and the adhesive surface includes an active adhesive portion having the same shape as the shape of the sealing member of the sealed contact lens package, and the adhesive surface includes a deadened adhesive portion disposed between the active adhesive portion and the perimeter of the first panel.

As shown in the embodiment illustrated in FIG. 20, embodiments of the present packages have first panels and third panels that have proximal end edges, and the proximal end edge of the third panel is aligned with the proximal end edge of the first panel.

FIG. 21 also illustrates the UDI 340 that is provided on the first panel 330. The UDI 340 is a unique device identifier that is provided in both a human readable form 344, such as text or numbers, and a machine readable form 342, such as a bar code. In addition, other information can be provided on the first panel 330 in addition to the UDI 340, such as other text, numbers, or graphics, and other bar codes.

Figure 22:
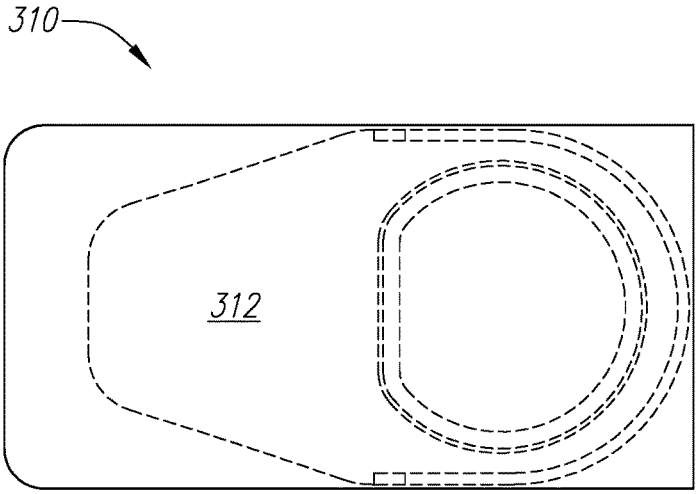
FIG. 22 is a bottom plan view of the contact lens package of FIG. 19.

FIG. 22 provides a bottom plan view of the contact lens package 310 of FIG. 19. As described with respect to FIG. 4, the contact lens package 310 can include a shrink wrap or shrink sleeve that extends around the UDI wrap that is adhered to the sealed contact lens package. The shrink sleeve can include perforated segments along the side of the contact lens package. The perforated segments facilitate opening of the shrink sleeve. The shrink sleeve will form a relatively tight fit over the contact lens package, and will not add substantially to the dimensions of the contact lens package without the sleeve.

In addition, the shrink sleeve can provide protection to the information contained on the first panel by preventing the information from being rubbed or worn off. The shrink sleeve can also help reduce particulate contamination with the sealed contact lens package during handling and distribution.

Figure 23:
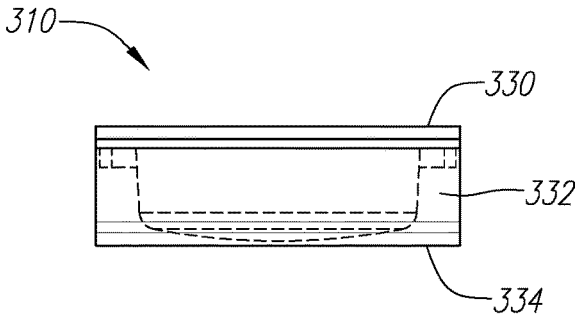
FIG. 23 is a front plan view of the contact lens package of FIG. 19.
Figure 24:
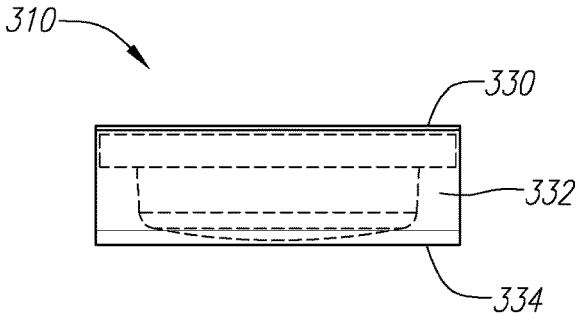
FIG. 24 is a rear plan view of the contact lens package of FIG. 19.

FIG. 23 illustrates a front plan view of the contact lens package 310 of FIG. 19. FIG. 24 illustrates a rear plan view of the contact lens package of FIG. 19.

In view of the description of the embodiment of FIGS. 19-24, it can be understood that some embodiments have a first panel with a proximal end edge and a third panel with a proximal end edge, and the proximal end edge of the third panel of the wrap overlays the proximal end edge of the first panel wrap.

FIGS. 25-30 illustrate a fifth embodiment of the present contact lens packages.

Figure 25:
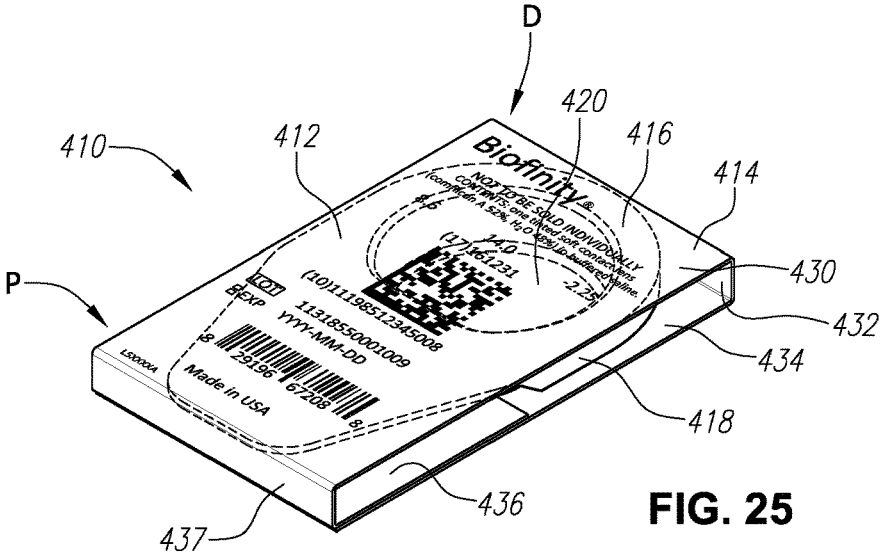
FIG. 25 is a perspective view of a contact lens package having a four-paneled wrap.
Figure 26:
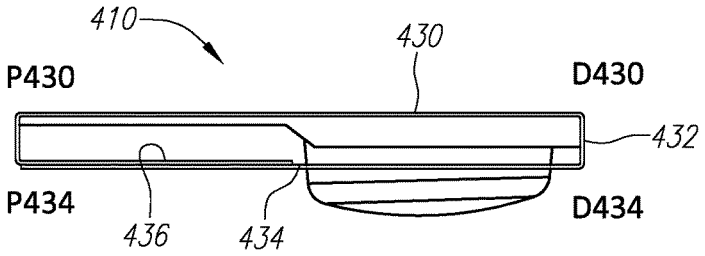
FIG. 26 is a side plan view of the contact lens package of FIG. 25.

FIG. 25 illustrates a contact lens package 410 includes a sealed contact lens package 412 and a wrap (UDI wrap) 414 coupled to the sealed contact lens package 412. The base member 418 includes a cavity 420, which is hermetically sealed by a sealing member 416. (The details of the sealing member are not illustrated in the majority of the drawings for convenience, but reference can be made to FIG. 60 to understand the relationship between the sealing member and the base member). A contact lens, such as a hydrogel or silicone hydrogel contact lens (not shown), is provided in the cavity 420. Also shown in FIG. 25 is that the contact lens package 410 has a proximal end P and a distal end D, which corresponds to the proximal end and distal end of the sealed contact lens package, respectively. Stated differently, the proximal end refers to the portion of the base member that has a finger or thumb grip, and the distal end refers to the portion of the base member on the opposite end. The wrap 414 is illustrated as including five panels, a first panel 430, a second panel 432, a third panel 434, a fourth panel 437, and a fifth panel 436. The panel arrangement is also shown in FIG. 26. In this embodiment, the wrap can be made from card stock or other similarly rigid material, or it can be made from flexible plastic materials, such as polypropylene films. Preferably, the wrap is card stock.

In FIG. 26, the first panel 430 is illustrated, and the first panel 430 has an adhesive surface. The adhesive surface is adhered to the sealing member of the sealed contact lens package. As shown in FIG. 26, the first panel has a proximal end P430 and a distal end D430. The proximal end P430 is adjacent to the proximal end P of the sealed contact lens package. The distal end D430 is adjacent the distal end of the sealed contact lens package. The second panel 432 extends from the distal end of the first panel. The third panel 434 also includes a proximal end P434 and a distal end D434. The distal end D434 is adjacent the second panel 432. Fourth panel 437 is illustrated as being connected to the proximal end P430 of the first panel 430 and extending downwardly to the proximal end P434 of third panel 434. Fifth panel 436 extends from the depending edge of the fourth panel 437 and is overlaid by the third panel 434 such that the proximal end P434 is adjacent the depending edge of the fourth panel 437. The third panel 434 also includes an opening or cutout 438 (FIG. 28) to allow at least a portion of the base member 418 to extend through the opening 438.

Figure 27:
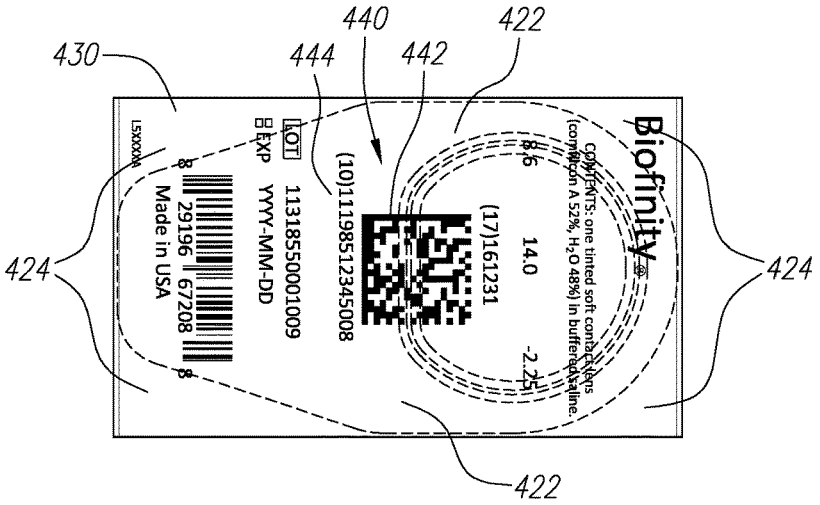
FIG. 27 is a top plan view of the contact lens package of FIG. 25.

FIG. 27 provides a top plan view of the contact lens package of FIG. 25 and FIG. 26. FIG. 27 illustrates one pattern of how adhesive is provided on the first panel 430. It is shown that the first panel 430 has an active adhesive region 422 and a deadened adhesive region 424. The active adhesive region 422 overlays substantially all of the surface of the sealing member, and the deadened adhesive region 424 is made to not adhere and is provided in one or more regions around the perimeter of the sealing member. With such an arrangement, it is possible to ensure that the first panel 430 is removed with the sealing member when a person desires to open the sealed contact lens package to access the unworn contact lens. Preferably, the adhesive is a permanent adhesive, and a variety of adhesives can be used to couple the first panel to the sealing member. In certain embodiments, the adhesive is an acrylic adhesive, such as those described above.

In view of the discussion above, and as shown in FIG. 27, embodiments of the present contact lens packages can include a UDI wrap having a first panel that has a perimeter, and the adhesive surface includes an active adhesive portion having the same shape as the shape of the sealing member of the sealed contact lens package, and the adhesive surface includes a deadened adhesive portion disposed between the active adhesive portion and the perimeter of the first panel.

As shown in the embodiment illustrated in FIG. 26, embodiments of the present packages have first panels and third panels that have proximal end edges, and the proximal end edge of the third panel is aligned with the proximal end edge of the first panel.

FIG. 27 also illustrates the UDI 440 that is provided on the first panel 430. The UDI 440 is a unique device identifier that is provided in both a human readable form 444, such as text or numbers, and a machine readable form 442, such as a bar code. In addition, other information can be provided on the first panel 430 in addition to the UDI 440, such as other text, numbers, or graphics, and other bar codes.

Figure 28:
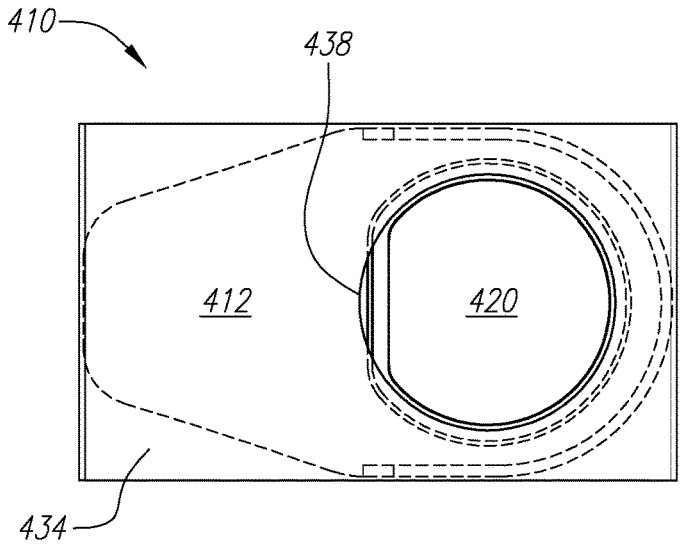
FIG. 28 is a bottom plan view of the contact lens package of FIG. 25.

FIG. 28 provides a bottom plan view of the contact lens package 410 of FIG. 25. As described with respect to FIG. 4, the contact lens package 410 can include a shrink wrap or shrink sleeve that extends around the UDI wrap that is adhered to the sealed contact lens package. The shrink sleeve can include perforated segments along the side of the contact lens package. The perforated segments facilitate opening of the shrink sleeve. The shrink sleeve will form a relatively tight fit over the contact lens package, and will not add substantially to the dimensions of the contact lens package without the sleeve.

In addition, the shrink sleeve can provide protection to the information contained on the first panel by preventing the information from being rubbed or worn off. The shrink sleeve can also help reduce particulate contamination with the sealed contact lens package during handling and distribution. However, it can be understood that the shrink sleeve is optional for this embodiment since additional securement of the sealed contact lens package in the wrap is achieved by the opening 438 accommodating the cavity portion of the sealed contact lens package 418.

In addition, in some versions of these embodiments, the adhesive can be optional due to the retention of the sealed contact lens package provided by opening 438.

Figure 29:
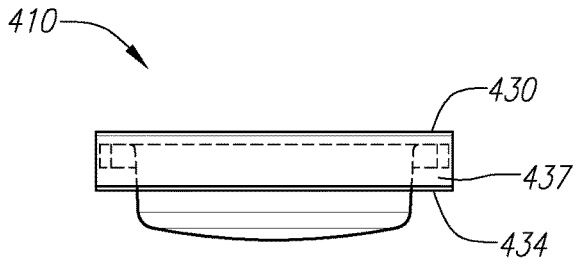
FIG. 29 is a front plan view of the contact lens package of FIG. 25.
Figure 30:
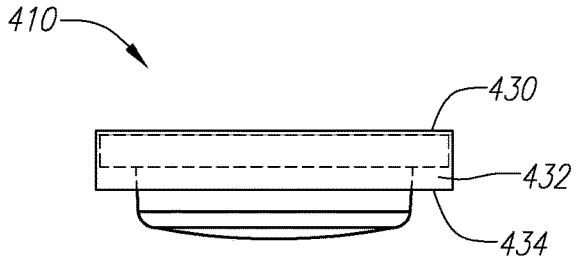
FIG. 30 is a rear plan view of the contact lens package of FIG. 25.

FIG. 29 illustrates a front plan view of the contact lens package 410 of FIG. 25. FIG. 30 illustrates a rear plan view of the contact lens package of FIG. 25.

As can be appreciated from the description of the embodiment of FIGS. 25-30, some embodiments of the present contact lens packages can be understood to include a wrap that further includes a fourth panel that descends from the proximal edge of the first panel, and a fifth panel connected to the fourth panel. The fifth panel has a distal end edge located more proximally to the cavity of the sealed contact lens package. In still further embodiments, the fifth panel is located between the base member and the third panel of the wrap, and the third panel of the wrap includes an opening to accommodate the cavity or bottom of the base member.

FIGS. 31-36 illustrate a sixth embodiment of the present contact lens packages.

Figure 31:
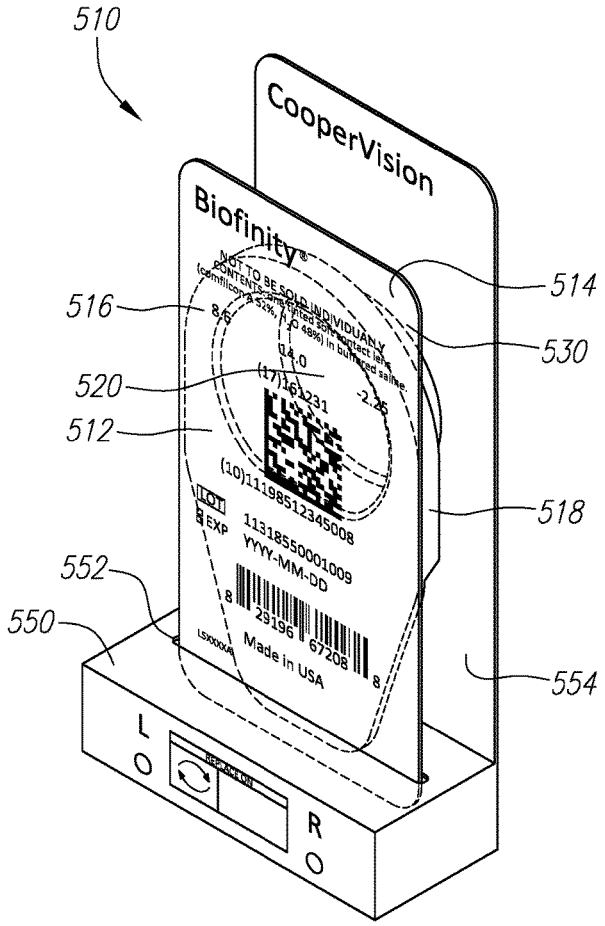
FIG. 31 is a perspective view of a contact lens package having a four-paneled wrap.

FIG. 31 illustrates a contact lens package 510 includes a sealed contact lens package 512 and a wrap (UDI wrap) 514 coupled to the sealed contact lens package 512. The base member 518 includes a cavity 520, which is hermetically sealed by a sealing member 516. (The details of the sealing member are not illustrated in the majority of the drawings for convenience, but reference can be made to FIG. 60 to understand the relationship between the sealing member and the base member). A contact lens, such as a hydrogel or silicone hydrogel contact lens (not shown), is provided in the cavity 520. The wrap 514 is illustrated as including one panel 530. In this embodiment, the wrap can be made from card stock or other similarly rigid material, or it can be made from flexible plastic materials, such as polypropylene films. Preferably, the wrap is a flexible plastic material.

The contact lens package 510 further includes a base member 550 that includes a slot 552 to receive a proximal end of the sealed contact lens package; and a back surface 554 extending from the base member 550 toward a distal end of the sealed contact lens package.

Figure 32:
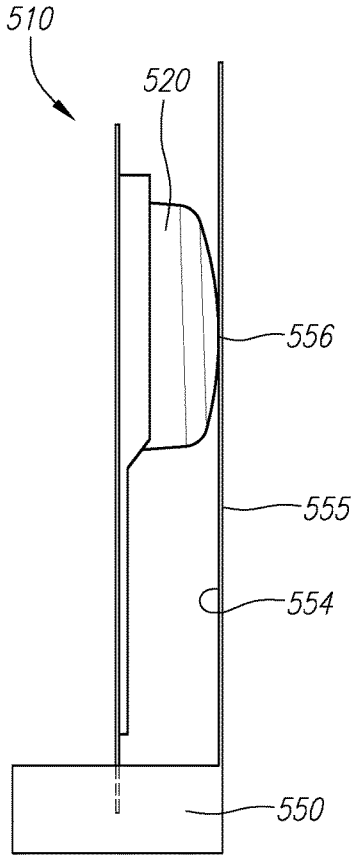
FIG. 32 is a side plan view of the contact lens package of FIG. 31.

In FIG. 32, illustrates a side view of the contact lens package 510. Although the sealed contact lens package 512 can be mechanically coupled to the base member 550 by way of the physical engagement with the perimeter edges of the slot 552, an adhesive 556 can be provided between the base member 518 and the back surface 554. An exposed rear surface 555 opposes back surface 554. As described above, any suitable adhesive can be used to further secure the sealed contact lens package with the UDI wrap 514 to the base member 550 or back surface 554.

Figure 33:
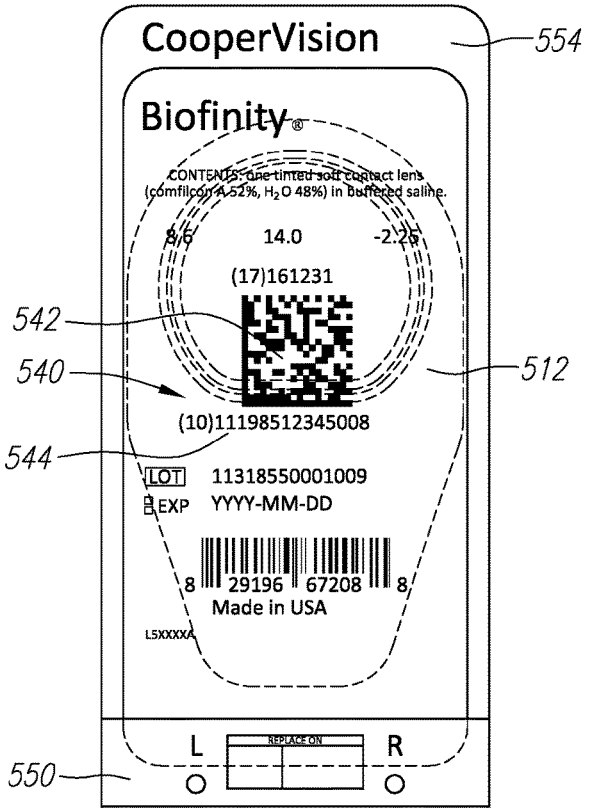
FIG. 33 is a front plan view of the contact lens package of FIG. 31.

FIG. 33 provides a front plan view of the contact lens package of FIG. 31 and FIG. 32. Similar to the embodiments described above, the adhesive can be provided in active regions corresponding to the shape of the sealing member 516, and deadened regions. FIG. 33 also illustrates the UDI 540 that is provided on the first panel 530. The UDI 540 is a unique device identifier that is provided in both a human readable form 544, such as text or numbers, and a machine readable form 542, such as a bar code. In addition, other information can be provided on the first panel 530 in addition to the UDI 540, such as other text, numbers, or graphics, and other bar codes.

In view of the discussion above, and as shown in FIG. 33, embodiments of the present contact lens packages can include a UDI wrap having a first panel that has a perimeter, and the adhesive surface includes an active adhesive portion having the same shape as the shape of the sealing member of the sealed contact lens package, and the adhesive surface includes a deadened adhesive portion disposed between the active adhesive portion and the perimeter of the first panel.

Figure 34:
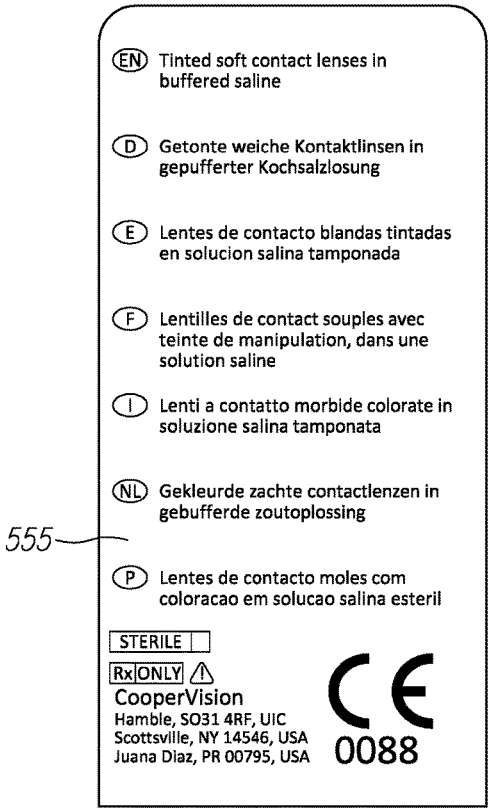
FIG. 34 is a rear plan view of the contact lens package of FIG. 31.

FIG. 34 provides a rear plan view of the contact lens package 510 of FIG. 31. In this view, exposed rear surface 555 includes human readable information, such as letters and numbers that may be required by regulatory agencies for contact lenses. As described with respect to FIG. 4, the contact lens package 510 can include a shrink wrap or shrink sleeve that extends around the UDI wrap that is adhered to the sealed contact lens package, or the combination of the UDI wrapped sealed contact lens package and base member. The shrink sleeve can include perforated segments along the side of the contact lens package. The perforated segments facilitate opening of the shrink sleeve. The shrink sleeve will form a relatively tight fit over the contact lens package, and will not add substantially to the dimensions of the contact lens package without the sleeve.

In addition, the shrink sleeve can provide protection to the information contained on the first panel by preventing the information from being rubbed or worn off. The shrink sleeve can also help reduce particulate contamination with the sealed contact lens package during handling and distribution. However, it can be understood that the shrink sleeve is optional for this embodiment since additional securement of the sealed contact lens package in the wrap is achieved by the slot 552 accommodating the proximal portion of the UDI wrapped sealed contact lens package.

Figure 35:
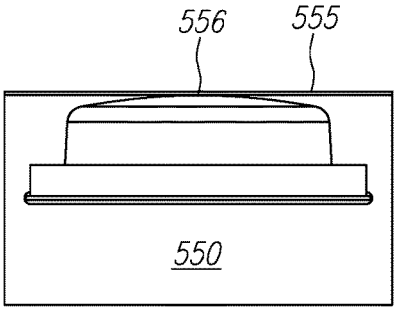
FIG. 35 is a top plan view of the contact lens package of FIG. 31.
Figure 36:
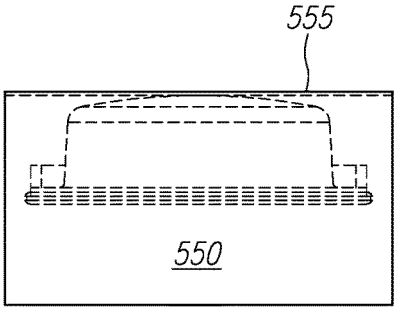
FIG. 36 is a bottom plan view of the contact lens package of FIG. 31.

FIG. 35 illustrates a top plan view of the contact lens package 510 of FIG. 31. FIG. 36 illustrates a bottom plan view of the contact lens package of FIG. 31.

As described in the embodiments for FIGS. 31-36, it can be understood that a contact lens package includes a base member that includes a slot to receive a proximal end of the sealed contact lens package, and a back surface extending from the base member toward a distal end of the sealed contact lens package.

Figure 37:
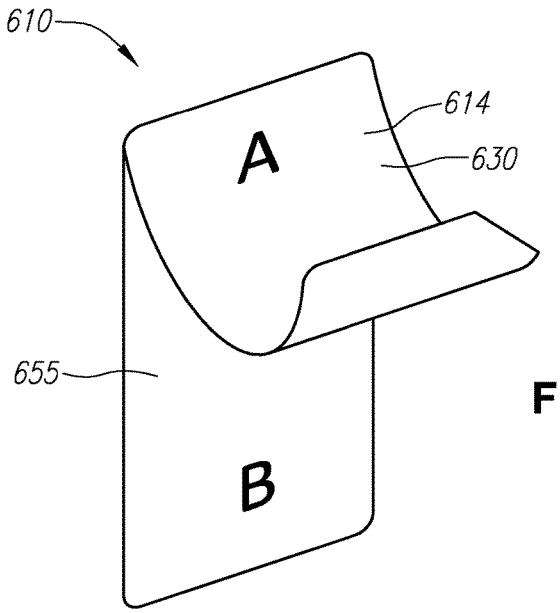
FIG. 37 is a perspective view of a UDI wrap for a contact lens package.
Figure 38:
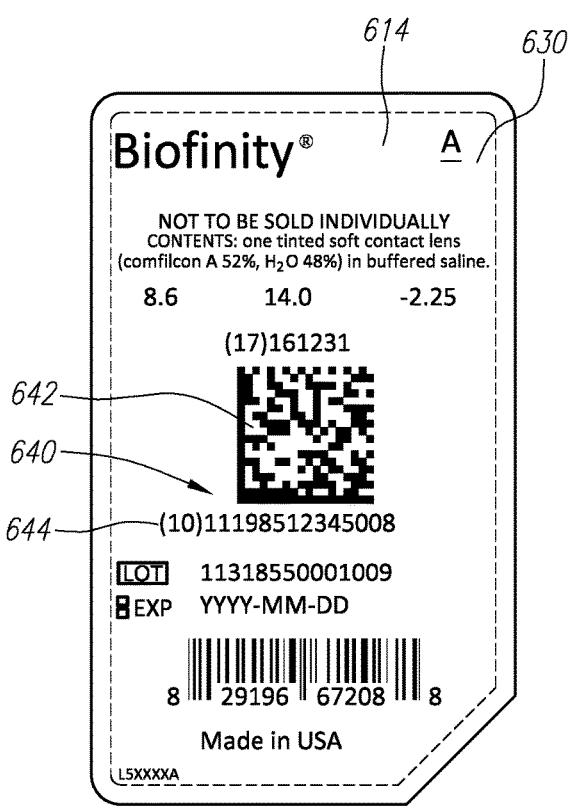
FIG. 38 is a front plan view of UDI wrap panel A of FIG. 37.
Figure 39:
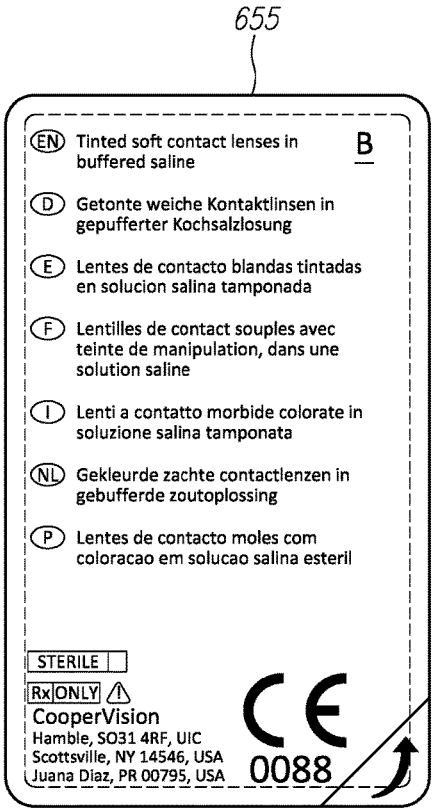
FIG. 39 is a front plan view of UDI wrap panel B of FIG. 37.

FIGS. 37-39 illustrate a seventh embodiment of the present contact lens packages, and more particularly, the wrap for the contact lens packages.

FIG. 37 illustrates a contact lens package 610 (the sealed contact lens package is not illustrated for purposes of convenience). In this embodiment, the wrap 614 is a two panel wrap. The wrap includes a first panel 630 and a second panel 655. The first panel 630 overlays second panel 655, and includes an adhesive to allow the panels to remain coupled together. The first panel 630 also includes the UDI 640 that comprises human readable information 644 and computer readable information 642. The second panel 655 includes human readable information, such as letters and numbers that may be required by regulatory agencies for contact lenses. The second panel 655 includes a permanent adhesive, as described herein, to couple the second panel to the sealing member of the sealed contact lens package. The first panel 630 also includes an adhesive to attach the first panel to the second panel 655, and to allow the separation of the first panel from the second panel, as needed, to access the information contained thereon.

As described with respect to FIG. 4, the contact lens package 610 can include a shrink wrap or shrink sleeve that extends around the UDI wrap that is adhered to the sealed contact lens package. The shrink sleeve can include perforated segments along the side of the contact lens package. The perforated segments facilitate opening of the shrink sleeve. The shrink sleeve will form a relatively tight fit over the contact lens package, and will not add substantially to the dimensions of the contact lens package without the sleeve.

The embodiments of FIG. 37-39 illustrate an embodiment where the wrap includes a first panel adhered to the sealing member of the sealed contact lens package, and a second panel adhered to the first panel. The second panel substantially overlays a major portion of the first panel. The second panel includes the printed surface that includes the unique device identifier in both human readable form and machine readable form.

FIGS. 40-45 illustrate an eighth embodiment of the present contact lens packages.

Figure 40:
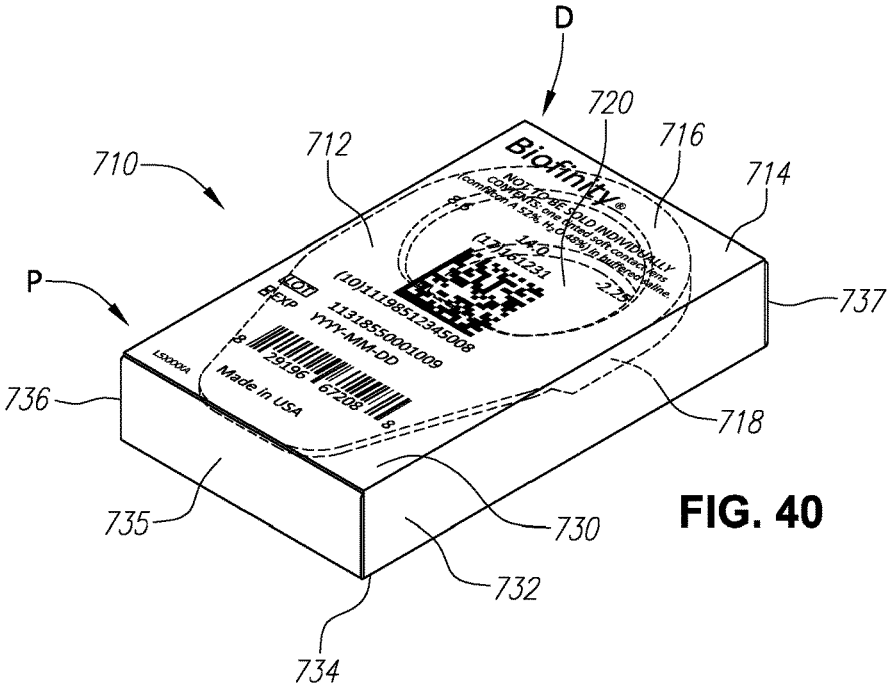
FIG. 40 is a perspective view of a contact lens package having a six-paneled wrap.

FIG. 40 illustrates a contact lens package 710 includes a sealed contact lens package 712 and a wrap (UDI wrap) 714 coupled to the sealed contact lens package 712. The base member 718 includes a cavity 720, which is hermetically sealed by a sealing member 716. A contact lens, such as a hydrogel or silicone hydrogel contact lens (not shown), is provided in the cavity 720. Also shown in FIG. 40 is that the contact lens package 710 has a proximal end P and a distal end D, which corresponds to the proximal end and distal end of the sealed contact lens package, respectively. Stated differently, the proximal end refers to the portion of the base member that has a finger or thumb grip, and the distal end refers to the portion of the base member on the opposite end. The wrap 714 is illustrated as including six panels, a first panel 730, a second panel 732, a third panel 734, a fourth panel 736, a fifth panel 375, and a sixth panel 737. Instead of wrapping the panels only around the distal end of the sealed contact lens package or only around the sides of the sealed contact lens package, in the embodiment of FIG. 40, the panels are wrapped around all of the sides of the sealed contact lens package thereby providing the sealed contact lens package in an enclosed UDI wrap 714. In this embodiment, the wrap 714 is made of card stock or other similarly rigid material.

Figure 41:
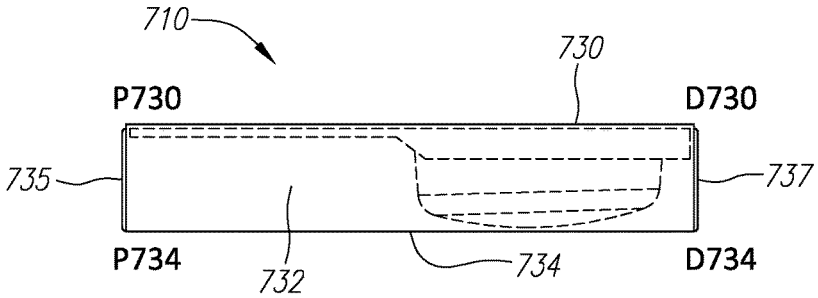
FIG. 41 is a side plan view of the contact lens package of FIG. 40.

As shown in FIG. 41, the first panel has a proximal end P730 and a distal end D730. The proximal end P730 is adjacent to the proximal end P of the sealed contact lens package. The distal end D730 is adjacent the distal end of the sealed contact lens package. The second panel 732 extends from the right side of the first panel. The third panel 734 also includes a proximal end P734 and a distal end D734. Although an adhesive is not required since the sealed contact lens package is enclosed in the wrap 714, an adhesive may be used to provide additional coupling, such as between the bottom of the base member 718 and the third panel 734 or between the first panel 730 and the sealing member 716.

Figure 42:
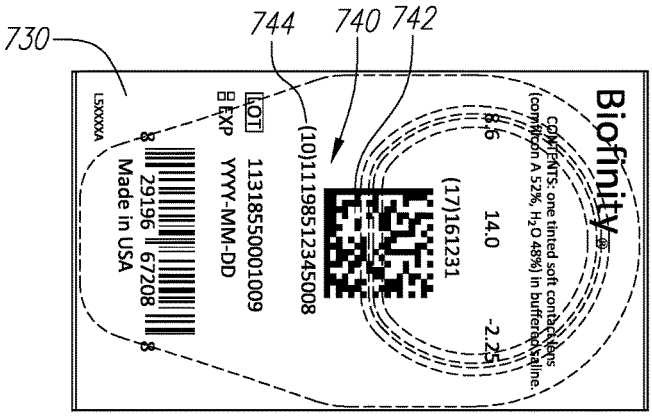
FIG. 42 is a top plan view of the contact lens package of FIG. 40.

FIG. 42 provides a top plan view of the contact lens package of FIG. 40 and FIG. 41. FIG. 42 also illustrates the UDI 740 that is provided on the first panel 730. The UDI 740 is a unique device identifier that is provided in both a human readable form 744, such as text or numbers, and a machine readable form 742, such as a bar code. In addition, other information can be provided on the first panel 730 in addition to the UDI 740, such as other text, numbers, or graphics, and other bar codes.

Figure 43:
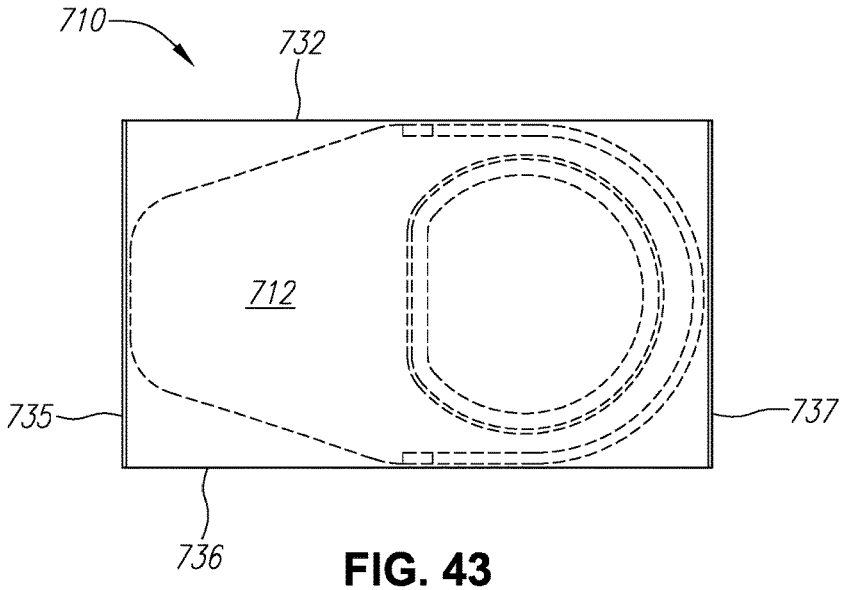
FIG. 43 is a bottom plan view of the contact lens package of FIG. 40.
Figure 44:
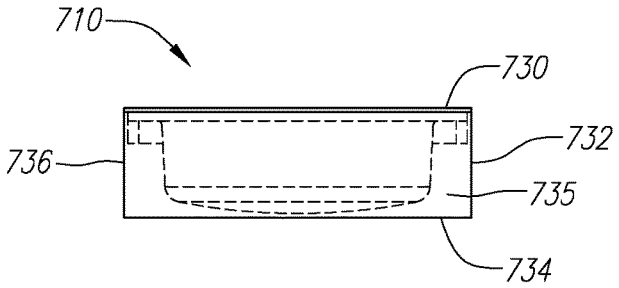
FIG. 44 is a front plan view of the contact lens package of FIG. 40.
Figure 45:
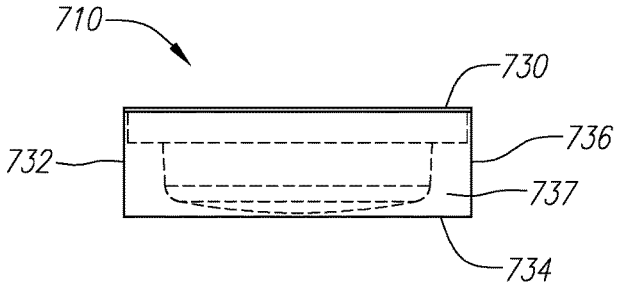
FIG. 45 is a rear plan view of the contact lens package of FIG. 40.

FIG. 43 provides a bottom plan view of the contact lens package 710 of FIG. 40. FIG. 44 illustrates a front plan view of the contact lens package 710 of FIG. 40. FIG. 45 illustrates a rear plan view of the contact lens package of FIG. 40.

Although not shown, similar to the embodiment of FIGS. 1-6, a shrink sleeve can be provided around the UDI wrap 730 of the contact lens package 710.

Additional embodiments of the present contact lens packages, including the embodiments of FIGS. 7-12 and FIGS. 40-45, can be understood to include (i) a first panel that includes the unique device identifier, the first panel includes a proximal end and an opposing distal end, and a left edge and a right edge extending from the proximal to the distal end; (ii) a second panel depending from said left edge of the first panel; (iii) a third panel depending from said right edge of the first panel; and (iv) a fourth panel connecting the second panel and the third panel and being positioned adjacent the cavity of the base member.

In some of the four-paneled embodiments described above, the first panel is a solid substrate having a perimeter defined by a proximal end edge, a distal end edge, the left edge, and the right edge. In other words, the first panel is free of a window, opening, or other transparent member.

In still further embodiments, such as those illustrated in FIGS. 40-45, the wrap may include a fifth panel connecting the proximal end edge of the first panel and the proximal end edge of the fourth panel; and a sixth panel connecting the distal end edge of the first panel and the distal end edge of the fourth panel.

FIGS. 46-51 illustrate a ninth embodiment of the present contact lens packages.

Figure 46:
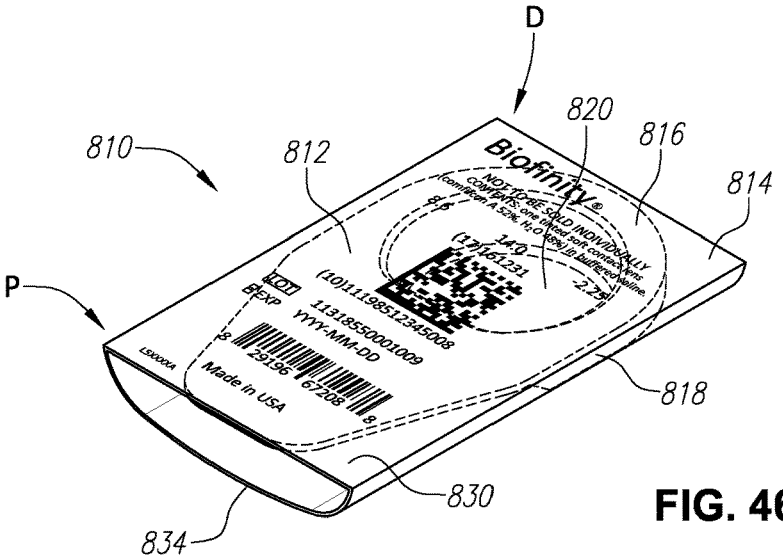
FIG. 46 is a perspective view of a contact lens package having a shrink sleeve wrap.
Figure 47:
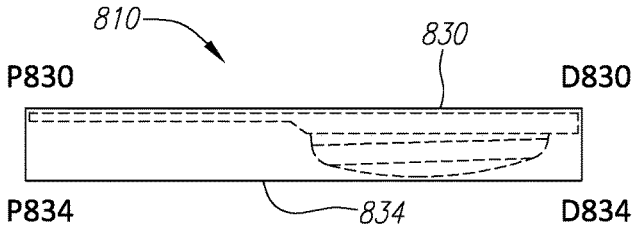
FIG. 47 is a side plan view of the contact lens package of FIG. 46.

FIG. 46 illustrates a contact lens package 810 includes a sealed contact lens package 812 and a wrap (UDI wrap) 814 coupled to the sealed contact lens package 812. The base member 818 includes a cavity 820, which is hermetically sealed by a sealing member 816. (The details of the sealing member are not illustrated in the majority of the drawings for convenience, but reference can be made to FIG. 60 to understand the relationship between the sealing member and the base member). A contact lens, such as a hydrogel or silicone hydrogel contact lens (not shown), is provided in the cavity 820. Also shown in FIG. 46 is that the contact lens package 810 has a proximal end P and a distal end D, which corresponds to the proximal end and distal end of the sealed contact lens package, respectively. Stated differently, the proximal end refers to the portion of the base member that has a finger or thumb grip, and the distal end refers to the portion of the base member on the opposite end. The wrap 814 is illustrated as including two panels, a first panel 830, and a second panel 834. The panel arrangement is also shown in FIG. 47. In this embodiment, the wrap can be made from flexible plastic materials, such as polypropylene films, or a combination of card stock and flexible plastic materials (e.g., the panel 830 can be card stock, and the panel 834 can be a flexible plastic material). In a preferred embodiment, the wrap 814 is a shrink sleeve made from biaxially oriented polypropylene (BOPP).

As shown in FIG. 47, the first panel has a proximal end P830 and a distal end D830. The proximal end P830 is adjacent to the proximal end P of the sealed contact lens package. The distal end D830 is adjacent the distal end of the sealed contact lens package. The second panel 834 also includes a proximal end P834 and a distal end D834.

Figure 48:
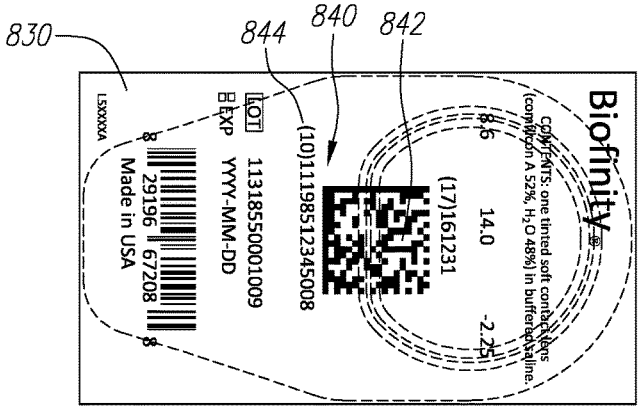
FIG. 48 is a top plan view of the contact lens package of FIG. 46.

FIG. 48 provides a top plan view of the contact lens package of FIG. 46 and FIG. 47. A UDI 840 is provided on the first panel 830. The UDI 840 is a unique device identifier that is provided in both a human readable form 844, such as text or numbers, and a machine readable form 842, such as a bar code. In addition, other information can be provided on the first panel 830 in addition to the UDI 840, such as other text, numbers, or graphics, and other bar codes. Preferably, the UDI 840 is printed directly onto the shrink sleeve material. The shrink sleeve can include some pre-printed information that is present prior to coupling it to the sealed contact lens package 812, and then it can be printed with variable information, including the UDI information after being coupled to the sealed contact lens package.

Figure 49:
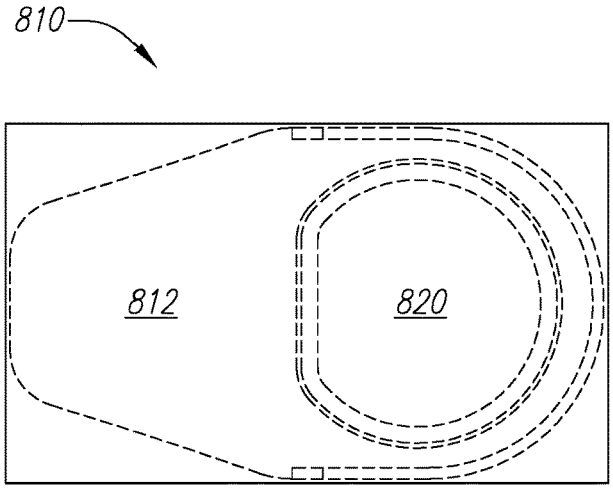
FIG. 49 is a bottom plan view of the contact lens package of FIG. 46.
Figure 50:
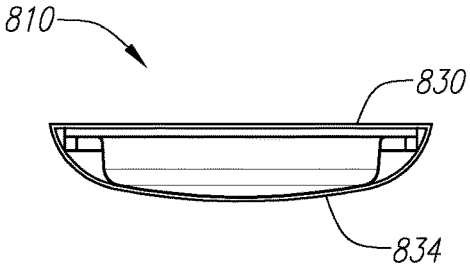
FIG. 50 is a front plan view of the contact lens package of FIG. 46.
Figure 51:
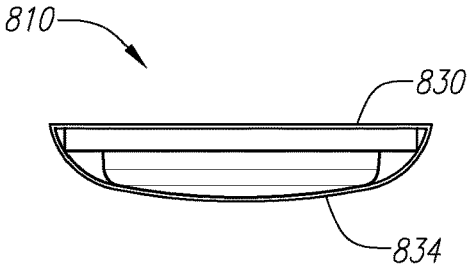
FIG. 51 is a rear plan view of the contact lens package of FIG. 46.

FIG. 49 provides a bottom plan view of the contact lens package 810 of FIG. 46. FIG. 50 illustrates a front plan view of the contact lens package 810 of FIG. 46. FIG. 51 illustrates a rear plan view of the contact lens package of FIG. 46.

As can be appreciated from the description of FIGS. 46-51, some embodiments of the contact lens packages my include a wrap that is a shrink sleeve having printing on the first panel.

The present contact lens packages are dimensioned or sized and shaped to enable the individual contact lens packages to fit within contact lens trial set or fitting set containers. Thus, the wraps of the contact lens packages should not substantially increase the dimensions of the sealed contact lens package. However, a variety of dimensions are embodied within the present contact lens packages. For example, the present contact lens packages can have a maximum width from about 25 mm to about 40 mm. In some embodiments, the maximum width is about 30 mm to 40 mm. The maximum length of the contact lens package can vary from about 40 mm to about 70 mm. In some embodiments, the contact lens package has a maximum length from about 50 mm to about 60 mm. In at least one embodiment, the maximum width of the package can be from 33-35 mm and the maximum length of the package can be from 54-56 mm. The printed information, including the UDI information, should fit within the dimensions of the package, and still provide an unprinted border around the information. One example of suitable print dimensions in view of the package dimensions above is approximately 25 mm wide and 45 mm long. The maximum height of the contact lens packages typically is between 5 mm and 25 mm. In some embodiments, the maximum height of the contact lens package is from about 10 mm to about 20 mm. This maximum height typically corresponds to a region of the package near the cavity of the sealed contact lens package.

As mentioned herein, the present contact lens packages can also be provided in an array of more than one contact lens package. As examples, an array of contact lens packages may consist of two, three, four, or five contact lens packages coupled together to form an array. Additional examples may include more than five contact lens packages coupled together. In an array, a contact lens package is positioned adjacent at least one other contact lens package. In the array, each of the contact lens packages of the array of packages includes a base member and a sealing member sealed thereto, and as described herein with respect to the single packages. The array of contact lens packages also includes a UDI wrap, as described herein, coupled to the array of sealed contact lens packages. As one example, in an array, each sealing member for an individual base member can be understood to be a component of a sealing layer. The sealing layer spans the entire array of contact lens packages. Individual sealed packages can be separated from the array along perforations provided between two sealed contact lens packages.

Figure 52:
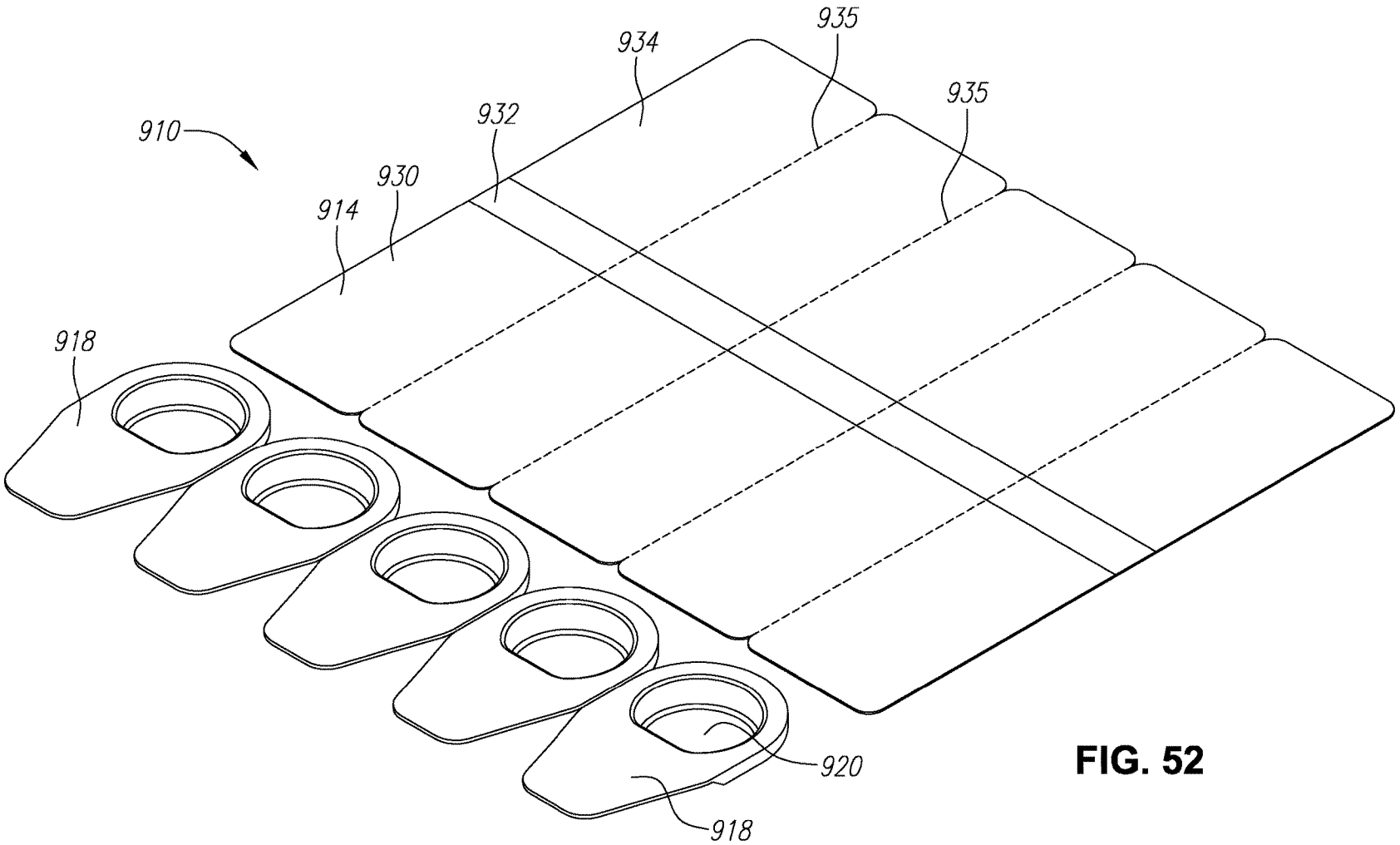
FIG. 52 is a perspective view of an unwrapped array of base members of a sealed contact lens package (without the sealing member attached) and an array of wraps, similar to those of FIG. 1.

FIG. 52 illustrates an array 910 of contact lens packages prior to assembly. As illustrated, and understood from the description herein, an array of base members 918 are provided, each base member has a cavity 920. An array wrap 914 is illustrated as having three panels, 930, 932, 934. This embodiment is similar to the three panel embodiment of FIGS. 1-6. Perforations 935 are provided between two wraps of the array wrap 914, and correspond to the location of perforations between sealing members of a sealing layer (not shown) that overlays the array of base members 918.

FIGS. 53-58 illustrate a tenth embodiment of the present contact lens packages, which is an assembled array of contact lens packages, as described for FIG. 52.

Figure 53:
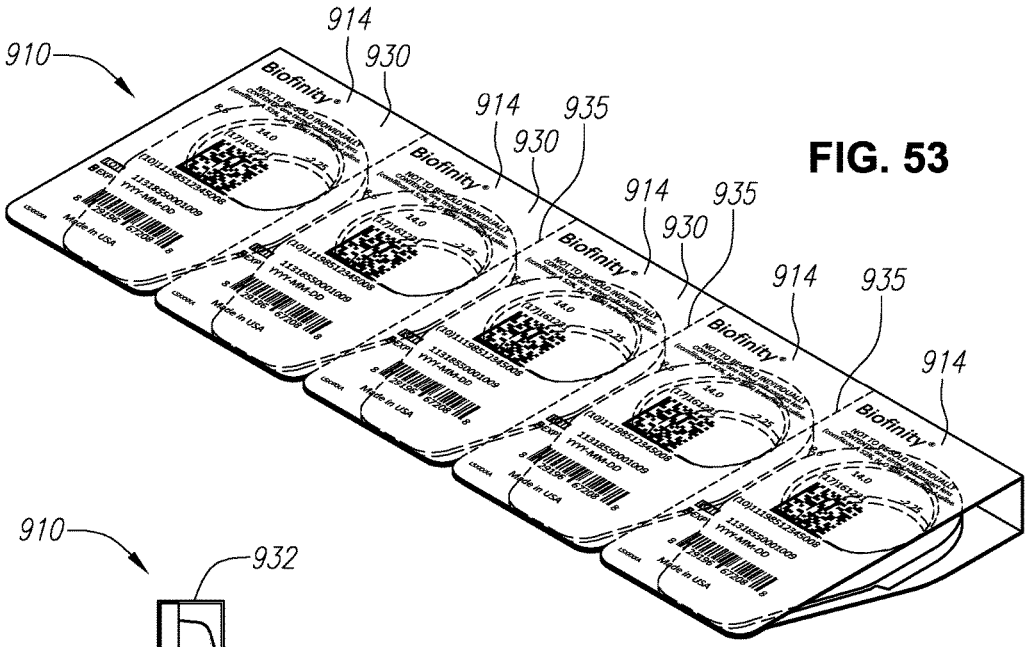
FIG. 53 is a perspective view similar to FIG. 52 with the array of base member wrapped with a three-panel wrap.

FIG. 53 illustrates a contact lens package array 910 that includes a plurality of sealed contact lens packages (e.g., five in this embodiment), coupled to a corresponding number of wraps 914. Each wrap 914 has a first panel 930, a second panel 932, and a third panel 934 (see FIG. 54), as described for the embodiment of FIGS. 1-6. Perforations 935 are illustrated between two contact wrapped contact lens packages.

Figure 54:
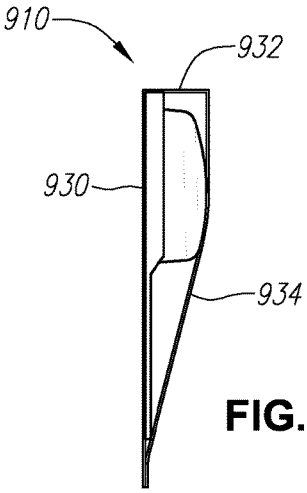
FIG. 54 is a side plan view of the array of FIG. 53.
Figure 55:
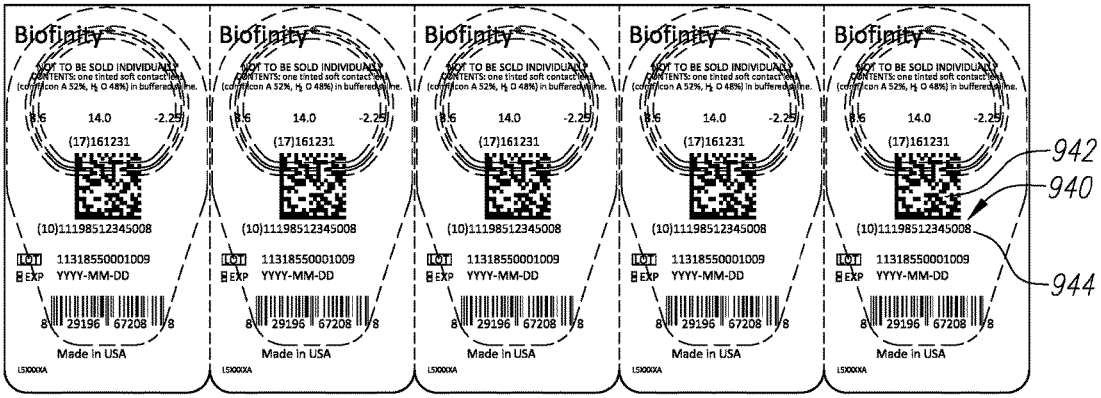
FIG. 55 is a top plan view of the array of FIG. 53.
Figure 56:
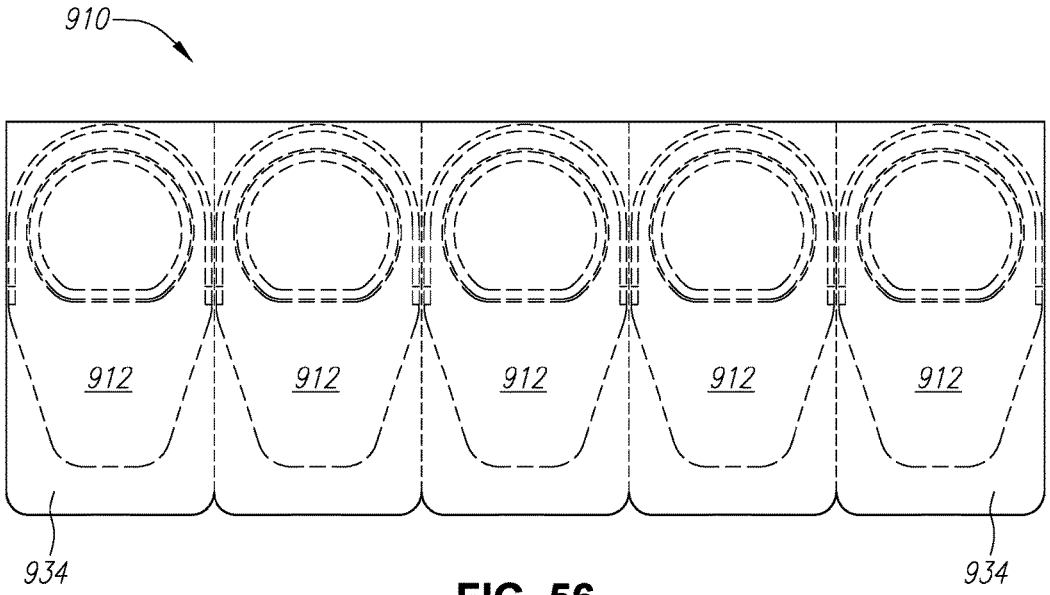
FIG. 56 is a bottom plan view of the array of FIG. 53.
Figure 57:
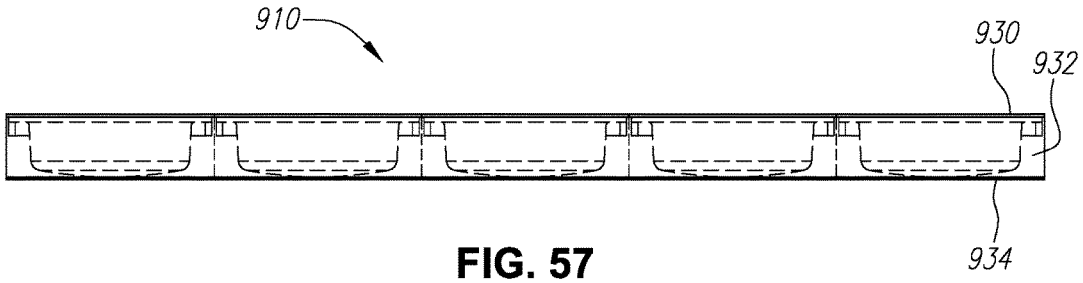
FIG. 57 is a front plan view of the array of FIG. 53.
Figure 58:
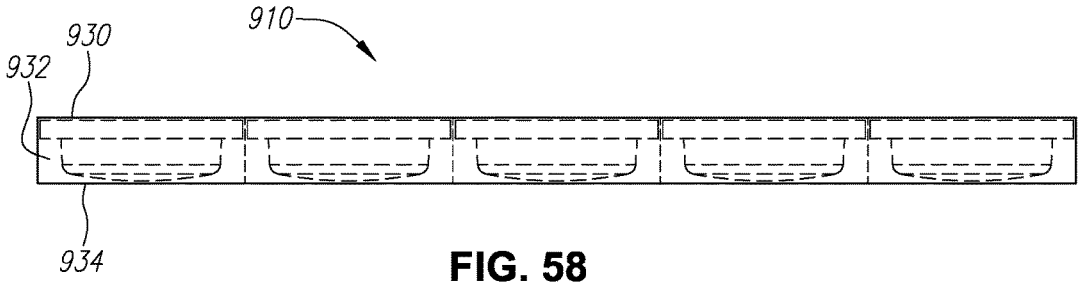
FIG. 58 is a rear plan view of the array of FIG. 53.

FIG. 54 illustrates the UDI 940 provided on each of the contact lens packages of the array, and each UDI comprises human readable information 944 and computer readable information 942, as described herein. FIG. 56 illustrates the bottom plan view of the array 910. FIG. 57 illustrates the front plan view of the array 910. FIG. 58 illustrates the rear plan view of the array 910.

As understood from the embodiments of FIGS. 52-58, a contact lens package may include more than one sealed contact lens packages arranged in an array. The sealed contact lens packages have perforations in the sealing member at a location corresponding to adjacent base members. The wrap can include multiple first panels that correspond to the same number of sealed contact lens packages. Each first panel includes a printed surface with the unique device identifier in both human readable form and machine readable form.

The present packages and arrays of packages can be made using conventional methods known to persons of ordinary skill in the art. For example, the base members of the packages and packages arrays can be injection molded from thermoplastic resin materials in an injection molding machine. A liquid, such as a contact lens packaging solution, can be dispensed in the cavity of the base member, and a contact lens can be inserted into the liquid. Alternatively, a contact lens can be placed into the cavity, and a liquid can then be dispensed in the cavity. The sealing member can then be applied to the sealing area of the base member to seal the liquid and contact lens in the cavity. The sealed package containing the hydrated contact lens can then be sterilized and prepared for distribution.

In accordance with another aspect of the present invention, a method of manufacturing a contact lens package, including arrays of contact lens packages, includes a step of providing a sealed contact lens package. The sealed contact lens package is as described herein, and includes a base member and a sealing member coupled to the base member to provide a cavity. An unworn contact lens is provided in a contact lens packaging solution within the cavity. The method also includes a step of coupling a wrap to the sealed contact lens package. The wrap includes at least one panel, which includes a printed surface that includes a unique device identifier in both human readable form and computer readable form. The human readable form includes numbers, letters, or both. The machine readable form includes a barcode (i.e., one or more barcodes).

In some embodiments, the base member is a thermoplastic materials that includes a cavity and a substantially planar surface surrounding the cavity. The substantially planar surface provides a sealing surface for the sealing member. Some examples include those described hereinabove. In some embodiments, the method may include the additional step of adhering an adhesive surface of a first panel of the wrap to the sealing member, wherein the first panel includes a proximal end adjacent to a proximal end of the sealed contact lens package, and a distal end adjacent to the distal end of the sealed contact lens package.

In a further embodiment, a step of folding a second panel of the wrap is provided. The second panel is folded to extend from the distal end of the first panel. In yet an additional embodiment, the method comprises a step of folding the third panel of the wrap, where the third panel includes a proximal end and distal end and it is folded so that the distal end of the third panel is adjacent the second panel.

Figure 59:
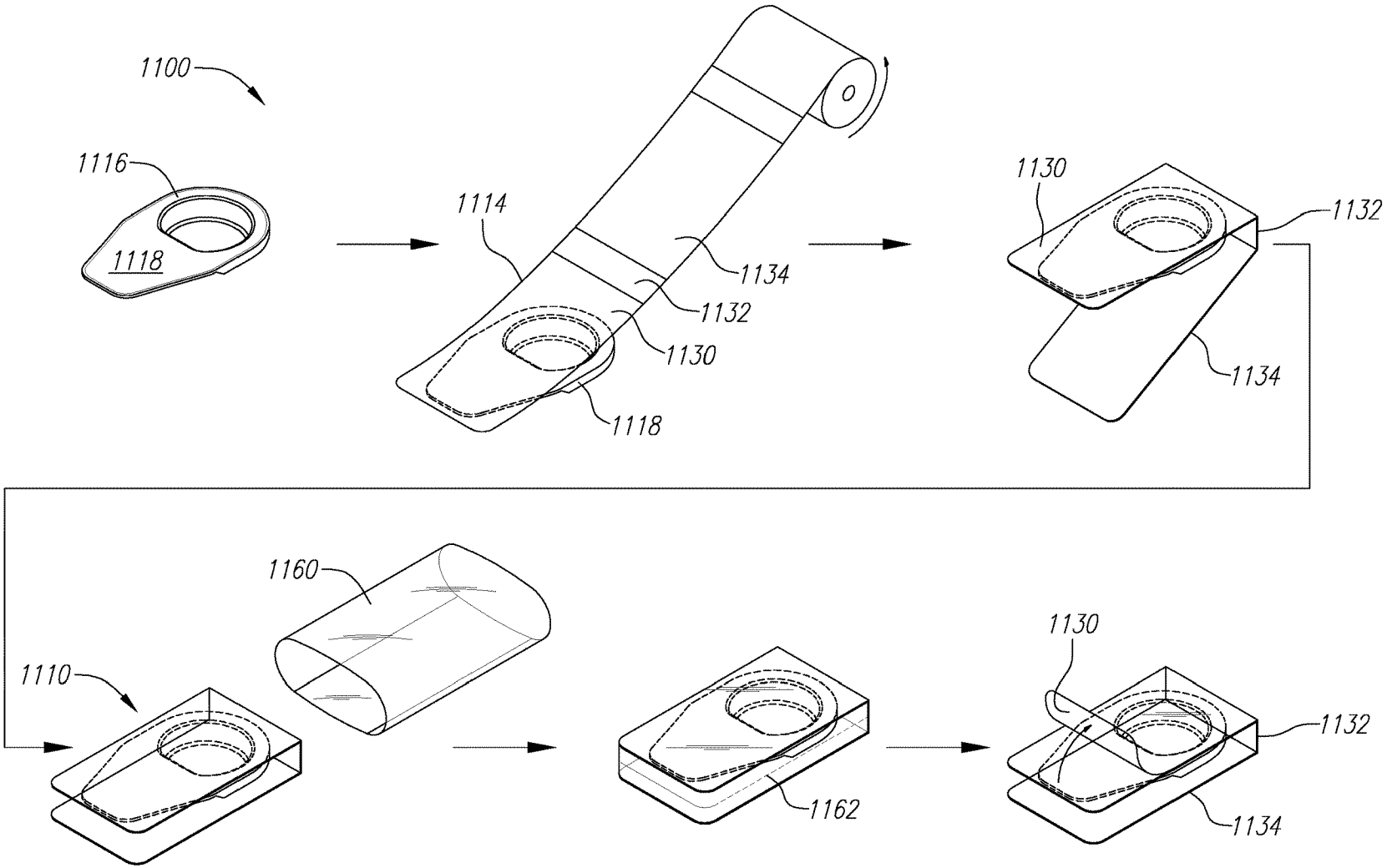
FIG. 59 is an illustration depicting a method of manufacturing a contact lens package.

One example of the present methods is illustrated in FIG. 59. A method 1100 of manufacturing a contact lens package is provided. A sealed contact lens package is provided and includes a base member 1118 and a sealing member 1116 coupled thereto, and as described herein. The sealed contact lens package is placed in contact with a first panel 1130 of a wrap 1114 such that an adhesive surface contacts the sealing member 1116 is couples the first panel 1130 to the sealing member 1116. The wrap 1114 is provided on a roll and unrolls as the sealed contact lenses are coupled to the wrap 1114. The second panel 1132 and the third panel 1134 are thus folded so that the proximal end of the third panel is aligned with the proximal end of the first panel. A shrink sleeve 1160 receives the contact lens package with the UDI wrap 1114. The shrink sleeve 1160 is shrunk to provide a snug fit around the wrapped contact lens package. Subsequently, the contact lens package can be opened by separating the shrink sleeve along perforations 1162. When the first panel 1130 is pulled away from the base member, the sealing member 1116 is separated from the base member as well, thereby revealing the unworn contact lens contained in the cavity formed between the base member and the sealing member.

Although the disclosure herein refers to certain specific embodiments, it is to be understood that these embodiments are presented by way of example and not by way of limitation. Any feature or combination of features described herein are included within the scope of the present invention provided that the features included in any such combination are not mutually inconsistent as will be apparent from the context, this specification, and the knowledge of one of ordinary skill in the art. In addition, any feature or combination of features may be specifically excluded from any embodiment disclosed herein. The intent of the foregoing detailed description, although discussing exemplary embodiments, is to be construed to cover all modifications, alternatives, and equivalents of the embodiments described in the present description and claims.

What is claimed is:

1. A contact lens package, comprising:

a plurality of sealed contact lens packages arranged in an array and having perforations in the sealing member at a location corresponding to adjacent base members, wherein each sealed contact lens package includes a base member, and a sealing member coupled to the base member to provide a sealed cavity, and an unworn contact lens is provided in a contact lens packaging solution within the sealed cavity;

a wrap comprising at least one panel that comprises a printing surface that comprises a unique device identifier in both a human readable form including numbers or letters, or combinations thereof, and a machine readable form including a barcode; and the base member is a thermoplastic material comprising a cavity and a substantially planar surface surrounding the cavity, said substantially planar surface providing a sealing surface for the sealing member; and the wrap includes an adhesive adhering the wrap to the sealing member; and wherein the wrap includes a plurality of first panels corresponding to the number of sealed contact lens packages, each first panel including a printed surface with the unique device identifier in both human readable form and machine readable form.

2. The package of claim 1, wherein the wrap comprises a first panel having an adhesive surface, said adhesive surface adhered to the sealing member, said first panel including a proximal end (P) adjacent to a proximal end of said sealed contact lens package and a distal end (D) adjacent to a distal end of said sealed contact lens package, a second panel extending from said distal end of said first panel; and a third panel including a proximal end and a distal end and said distal end being adjacent said second panel.

3. The package of claim 2, further comprising a shrink sleeve extending around the wrap adhered to the sealed contact lens package.

4. The package of claim 3, wherein the shrink sleeve includes at least one perforated segment to facilitate opening of the shrink sleeve.

5. The package of claim 2, wherein the first panel has a perimeter, and the adhesive surface includes an active adhesive portion having the same shape as the shape of the sealing member, and a deadened adhesive portion disposed between the active adhesive portion and the perimeter of the first panel.

6. The package of claim 2, wherein the proximal end of each of the third panel and first panel has a proximal end edge, and the proximal end edge of the third panel of the wrap is aligned with the proximal end edge of the first panel of the wrap.

7. The package of claim 2, wherein the proximal end of each of the third panel and first panel has a proximal end edge, and the proximal end edge of the first panel of the wrap overlays the proximal end edge of the third panel of the wrap.

8. The package of claim 2, wherein the proximal end of each of the third panel and first panel has a proximal end edge, and the proximal end edge of the third panel of the wrap overlays the proximal end edge of the first panel of the wrap.

9. The package of claim 2, wherein the wrap further comprises a fourth panel descending from the proximal edge of the first panel, and a fifth panel connected to the fourth panel and having a distal end edge located proximal to the cavity of the sealed contact lens package.

10. The package of claim 9, wherein the fifth panel is located between the base member and the third panel of the wrap; and the third panel of the wrap comprises an opening to accommodate the cavity of the base member.

11. The package of claim 1, wherein the wrap comprises (i) a first panel comprising the unique device identifier, said first panel including a proximal end and an opposing distal end, and a left edge and a right edge extending from the proximal to the distal end; (ii) a second panel depending from said left edge of the first panel; (iii) a third panel depending from said right edge of the first panel; and (iv) a fourth panel connecting the second panel and the third panel and being positioned adjacent the cavity of the base member.

12. The package of claim 11, wherein the first panel is a solid substrate having a perimeter defined by a proximal end edge, a distal end edge, the left edge, and the right edge.

13. The package of claim 11, wherein the wrap further comprises (v) a fifth panel connecting the proximal end edge of the first panel and the proximal end edge of the fourth panel; and (vi) a sixth panel connecting the distal end edge of the first panel and the distal end edge of the fourth panel.

14. The package of claim 11, wherein the wrap is a shrink sleeve having printing on the first panel.

15. The package of claim 1, further comprising a base member including a slot to receive a proximal end of the sealed contact lens package; and a back surface extending from the base member toward a distal end of the sealed contact lens package.

16. The package of claim 1, wherein the wrap comprises a first panel adhered to the sealing member of the sealed contact lens package, and a second panel adhered to the first panel and substantially overlaying a major portion of the first panel, the second panel including the printed surface that comprises the unique device identifier in both human readable form and machine readable form.

17. A method of manufacturing a contact lens package, comprising:

providing a sealed contact lens package, said sealed contact lens package comprising a base member, a sealing member coupled to the base member to provide a sealed cavity, and an unworn contact lens provided in a contact lens packaging solution within the sealed cavity;

coupling a wrap to the sealed contact lens package, said wrap comprising at least one panel that includes a printed surface comprising a unique device identifier in both human readable form comprising numbers, or letters, or combinations thereof, and machine readable form comprising a barcode; and adhering the wrap to the sealing member.

18. The method of claim 17, wherein the base member is a thermoplastic material comprising a cavity and a substantially planar surface surrounding the cavity, said substantially planar surface providing a sealing surface for the sealing member; and said at least one panel is a first panel including a proximal end adjacent to a proximal end of said sealed contact lens package and a distal end adjacent to a distal end of said sealed contact lens package, folding a second panel of the wrap to extend from said distal end of said first panel; and folding a third panel of the wrap, said third panel including a proximal end and a distal end so that said distal end of the third panel is adjacent said second panel.

* * * * *